US008212648B2

(12) United States Patent
Yan et al.

(10) Patent No.: US 8,212,648 B2
(45) Date of Patent: Jul. 3, 2012

(54) VARIABLE ATTENUATOR

(75) Inventors: Yuejun Yan, Shenzhen (CN); Yeupeng Yan, Shenzhen (CN)

(73) Assignee: Yantel Corporation, Shenzhen (CN)

( * ) Notice: Subject to any disclaimer, the term of this patent is extended or adjusted under 35 U.S.C. 154(b) by 225 days.

(21) Appl. No.: 12/703,859

(22) Filed: Feb. 11, 2010

(65) Prior Publication Data

US 2010/0141363 A1 Jun. 10, 2010

Related U.S. Application Data

(63) Continuation of application No. PCT/CN2008/071940, filed on Aug. 11, 2008, and a continuation-in-part of application No. 11/733,205, filed on Apr. 10, 2007, now Pat. No. 8,089,338, which is a continuation of application No. PCT/CN2005/000872, filed on Jun. 17, 2005.

(30) Foreign Application Priority Data

| | | |
|---|---|---|
| Oct. 13, 2004 | (CN) | 2004 1 0051879 |
| Aug. 11, 2007 | (CN) | 2007 1 0075714 |
| Oct. 31, 2007 | (CN) | 2007 1 0124352 |
| Nov. 20, 2007 | (CN) | 2007 1 0193881 |
| Feb. 5, 2008 | (CN) | 2008 1 0080717 |

(51) Int. Cl.
*H01C 1/012* (2006.01)

(52) U.S. Cl. ..... 338/308; 338/162; 333/81 R; 323/349

(58) Field of Classification Search ..... 338/160–162, 338/308; 333/81 R, 81 A; 323/349–351, 323/354
See application file for complete search history.

(56) References Cited

U.S. PATENT DOCUMENTS

| | | | | |
|---|---|---|---|---|
| 4,942,375 | A * | 7/1990 | Petitjean et al. | 333/81 R |
| 5,051,719 | A * | 9/1991 | Gaston et al. | 338/162 |
| 5,157,323 | A * | 10/1992 | Ali et al. | 323/369 |
| 5,309,048 | A * | 5/1994 | Khabbaz | 327/310 |
| 5,332,981 | A * | 7/1994 | Mazzochette et al. | 333/81 R |
| 5,563,557 | A * | 10/1996 | Sasaki | 333/81 R |
| 6,801,439 | B2 * | 10/2004 | Kambara | 361/766 |
| 6,903,621 | B2 * | 6/2005 | Malcolm et al. | 333/81 A |

* cited by examiner

*Primary Examiner* — Kyung Lee
(74) *Attorney, Agent, or Firm* — Matthias Scholl P.C.; Matthias Scholl

(57) ABSTRACT

A variable attenuator, including at least a one-stage attenuator circuit, including at least a signal input end, a signal output end, a common grounded end, a first serial resistor, a first parallel resistor, a first parallel switch, and a first serial switch. The first serial resistor is disposed between the signal input and the signal output end. The signal input end, the signal output end, and the first serial resistor form a main signal circuit. The first parallel resistor is connected between the main signal circuit and the common grounded end. The first parallel switch is connected in parallel with the first serial resistor, and the first serial switch is connected in series with the first parallel resistor. During operation of the variable attenuator, as the parallel switch is switched on to eliminate attenuation, the serial switch is switched off. This prevents the parallel resistor from affecting the main signal circuit and ensures stable attenuation with a higher degree of precision and a wider frequency range.

29 Claims, 39 Drawing Sheets

VARIABLE ATTENUATOR

CROSS-REFERENCE TO RELATED APPLICATIONS

This application is a continuation of International Patent Application No. PCT/CN2008/071940 with an international filing date of Aug. 11, 2008, designating the United States, now pending, and further claims priority benefits to Chinese Patent Application No. 200710075714.9 filed on Aug. 11, 2007, Chinese Patent Application No. 200710124352.8 filed on Oct. 31, 2007, Chinese Patent Application No. 200710193881.3 filed on Nov. 20, 2007 and Chinese Patent Application No. 200810080717.6 filed on Feb. 5, 2008. This application is also a continuation in part of U.S. Ser. No. 11/733,205 filed on Apr. 10, 2007, now pending, which is a continuation of International Patent Application No. PCT/CN2005/000872 with an international filing date of Jun. 17, 2005, which is based on Chinese Patent Application No. 200410051879.9 filed Oct. 13, 2004. The contents of all of the aforementioned applications, including any intervening amendments thereto, are incorporated herein by reference.

BACKGROUND OF THE INVENTION

1. Field of the Invention

The invention relates to an attenuator, and more particularly to a variable attenuator.

2. Description of the Related Art

In the family of electronic components, the variable attenuator is one of the common and basic components in electrical circuits and systems. The existence of a variable attenuator makes the fabrication of electrical circuits and the debugging of systems more flexible and convenient. Currently, the variable attenuator is being widely used in circuits and systems with operating frequencies below a few hundred megahertz (MHz).

However, there are several problems with the existing variable attenuator: first, the variation of attenuation is implemented by switching a main signal circuit, and a strong reflection signal (a burst pulse) may occur on the main signal circuit and damage a power tube of a previous stage during the switching process; moreover, the attenuator cannot be completely separated from the main signal circuit, and thus variation of attenuation is not easily implemented.

SUMMARY OF THE INVENTION

In view of the above-described problem, it is one objective of the invention to provide a variable attenuator capable of addressing the above-mentioned problems.

To achieve the above objectives, in accordance with one embodiment of the invention, provided is a variable attenuator, comprising at least one-stage attenuator circuit, comprising a signal input end, a signal output end, a common grounded end, a first serial resistor, a first parallel resistor, a first parallel switch, and a first serial switch, wherein the first serial resistor is disposed between the signal input and the signal output end, the signal input, the signal output end, and the first serial resistor form a main signal circuit, the first parallel resistor is connected between the main signal circuit and the common grounded end, the first parallel switch is parallel connected to the first serial resistor, and the first serial switch is serially connected to the first parallel resistor.

In a class of this embodiment, the first serial resistor, the first parallel resistor, the first serial switch, the first parallel switch, the signal input end, and the signal output end or the common grounded end are disposed on different substrates or insulators operating as switches.

In a class of this embodiment, the first parallel switch is implemented by a conductive sheet, or a signal microstrip line disposed on a substrate.

In a class of this embodiment, the first serial switch is implemented by a conductive sheet, or a signal microstrip line disposed on a substrate.

In a class of this embodiment, the at least one-stage attenuator circuit is a π-type attenuator circuit, the π-type attenuator circuit comprises a second parallel resistor and a second serial switch serially connected to each other, the first parallel resistor is connected between the signal input end and the common grounded end, and the second parallel resistor is connected between the signal output end and the common grounded end.

In a class of this embodiment, the at least one-stage attenuator circuit is an at least two-stage cascaded π-type attenuator circuit, a signal output end of a previous stage of the at least two-stage cascaded π-type attenuator circuit operates as a signal input end of a next stage of the at least two-stage cascaded π-type attenuator circuit, and a second parallel resistor connected between the signal output end and the common grounded end of the previous stage of the at least two-stage cascaded π-type attenuator circuit operates as a first parallel resistor between a signal input end and a common grounded end of the next stage of the at least two-stage cascaded π-type attenuator circuit.

In a class of this embodiment, the first serial resistor, the first parallel resistor, the second parallel resistor, the first serial switch, the second serial switch, the first parallel switch, the signal input end, and the signal output end or the common grounded end are disposed on different substrates or insulators operating as switches.

In a class of this embodiment, the first parallel switch, the first serial switch, or the second serial switch is implemented by a conductive sheet, or a signal microstrip line disposed on a substrate.

In a class of this embodiment, the π-type attenuator circuit is equivalent to a distributed resistor.

In a class of this embodiment, the at least one-stage attenuator circuit is a T-type attenuator circuit, the T-type attenuator circuit comprises a second serial resistor serially connected to the first serial resistor, and a second parallel switch parallel connected to the second serial resistor, one end of the first serial resistor is connected to the signal input end, one end of the second serial resistor is connected to the signal output end, the first parallel switch is parallel connected to the first serial resistor, and a connecting point between one end of the first parallel resistor and the main signal circuit is disposed between the first serial resistor and the second serial resistor.

In a class of this embodiment, the first serial resistor, the first parallel resistor, the second serial resistor, the first serial switch, the first parallel switch, the second parallel switch, the signal input end, and the signal output end or the common grounded end are disposed on different substrates or insulators operating as switches.

In a class of this embodiment, the T-type attenuator circuit is equivalent to a distributed resistor.

In a class of this embodiment, the first parallel switch, the second parallel switch, or the first serial switch is implemented by a conductive sheet, or a signal microstrip line disposed on a substrate.

In a class of this embodiment, the at least one-stage attenuator circuit is a T-type attenuator circuit, the T-type attenuator circuit comprises a second serial resistor serially connected to the first serial resistor, one end of the first serial resistor is connected to the signal input end, one end of the second serial resistor is connected to the signal output end, the first parallel switch is parallel connected between the end of the first serial resistor and that of the second serial resistor, and a connecting point between one end of the first parallel resistor and the main signal circuit is disposed between the first serial resistor and the second serial resistor.

In a class of this embodiment, the first serial resistor, the first parallel resistor, the second serial resistor, the first serial switch, the first parallel switch, the second parallel switch, the signal input end, and the signal output end or the common grounded end are disposed on different substrates or insulators operating as switches.

In a class of this embodiment, the T-type attenuator circuit is equivalent to a distributed resistor.

In a class of this embodiment, the first parallel switch, the second parallel switch, or the first serial switch is implemented by a conductive sheet, or a signal microstrip line disposed on a substrate.

In a class of this embodiment, the first serial switch is disposed between the first parallel resistor and the common grounded end, or between the first parallel resistor and the main signal circuit.

In a class of this embodiment, it further comprises at least one correcting circuit comprising a third parallel resistor and a circuit switch.

In a class of this embodiment, one end of the circuit switch is connected to the signal input end, the signal output end, or a cascade on the main signal circuit, the other end of the circuit switch is connected to one end of the third parallel resistor, and the other end of the third parallel resistor is disposed on a microstrip terminal, or connected to the ground directly or via a capacitor or an inductor.

In a class of this embodiment, the at least one-stage attenuator circuit is disposed on a substrate, or an insulator operating as a switch, and the first serial resistor, the first parallel resistor, the first serial switch, and the first parallel switch are disposed on the same layer or different layers of the substrate.

In a class of this embodiment, the variable attenuator is disposed in a coaxial connector.

In a class of this embodiment, the first serial resistor is a chip resistor, a thick film resistor, a thin film resistor, an embedded resistor, a printed resistor, or a combination thereof.

In a class of this embodiment, the first parallel resistor is a chip resistor, a thick film resistor, a thin film resistor, an embedded resistor, a printed resistor, or a combination thereof.

In accordance with another embodiment of the invention, provided is a variable attenuator, comprising at least one-stage bridge-type attenuator circuit, comprising a signal input end, a signal output end, a common grounded end, a serial resistor, a pair of bridge-arm resistors, a node, a parallel resistor, a parallel switch, and a serial switch, wherein the serial resistor is disposed between the signal input and the signal output end, the signal input, the signal output end, and the serial resistor form a main signal circuit, one end of each of the bridge-arm resistors is connected to the serial resistor, the other end of each of the bridge-arm resistors is connected to the node, the parallel resistor is disposed between the node and the common grounded end, the parallel switch is parallel connected to the serial resistor, and the serial switch is serially connected to the parallel resistor.

In a class of this embodiment, the serial switch is disposed between the parallel resistor and the common grounded end.

In a class of this embodiment, the serial switch is implemented by a conductive sheet, or a signal microstrip line disposed on a substrate.

In a class of this embodiment, the parallel switch is implemented by a conductive sheet, or a signal microstrip line disposed on a substrate.

In a class of this embodiment, the at least one-stage bridge-type attenuator circuit is disposed on a substrate, or an insulator operating as a switch, and the serial resistor, the parallel resistor, the serial switch, and the parallel switch are disposed on the same layer or different layers of the substrate.

In a class of this embodiment, the serial resistor is a chip resistor, a thick film resistor, a thin film resistor, an embedded resistor, a printed resistor, or a combination thereof.

In a class of this embodiment, the parallel resistor is a chip resistor, a thick film resistor, a thin film resistor, an embedded resistor, a printed resistor, or a combination thereof.

Advantages of the invention comprise: firstly, the invention employs the parallel switch parallel connected to the serial resistor, and the serial switch serially connected to the parallel resistor, as the parallel switch is switched on to eliminate attenuation on a certain stage, the serial switch is switched off, whereby preventing the parallel resistor from affecting the main signal circuit and ensuring stable attenuation with higher precision and a wider frequency range; moreover, switching of the main signal circuit is not required, which ensures that a signal is always transmitted on the main signal circuit and no reflection signal (burst pulse) is generated on the main signal circuit, and thus a circuit on a previous stage will not be damaged.

DETAILED DESCRIPTION OF THE EMBODIMENTS

Detailed description will be given below in junction with accompanying drawings.

In the invention, parallel switches are parallel connected to serial resistors in different stages of an attenuator circuit, and serial switches are serially connected to any one end of each parallel resistor, as the parallel switches are switched on to eliminate attenuation of a certain stage, the serial switch is switched off whereby preventing the parallel switch from affecting a main signal circuit.

In the invention, the attenuator circuit can be any typical attenuator circuit, such as a π-type attenuator circuit, a T-type attenuator circuit, a bridge-type attenuator circuit, and so on.

In the invention, a serial resistor refers to a resistor connected between a signal input end and a signal output end of the variable attenuator and forming a main signal circuit.

In the invention, a parallel refers to a resistor having an end connected to the main signal circuit directly or via other components, and another end connected to a common grounded end of the variable attenuator.

The parallel resistor and the serial resistor are chip resistors, thick film resistors, thin film resistors, embedded resistors, printed resistors, or combinations thereof.

Figure 1:
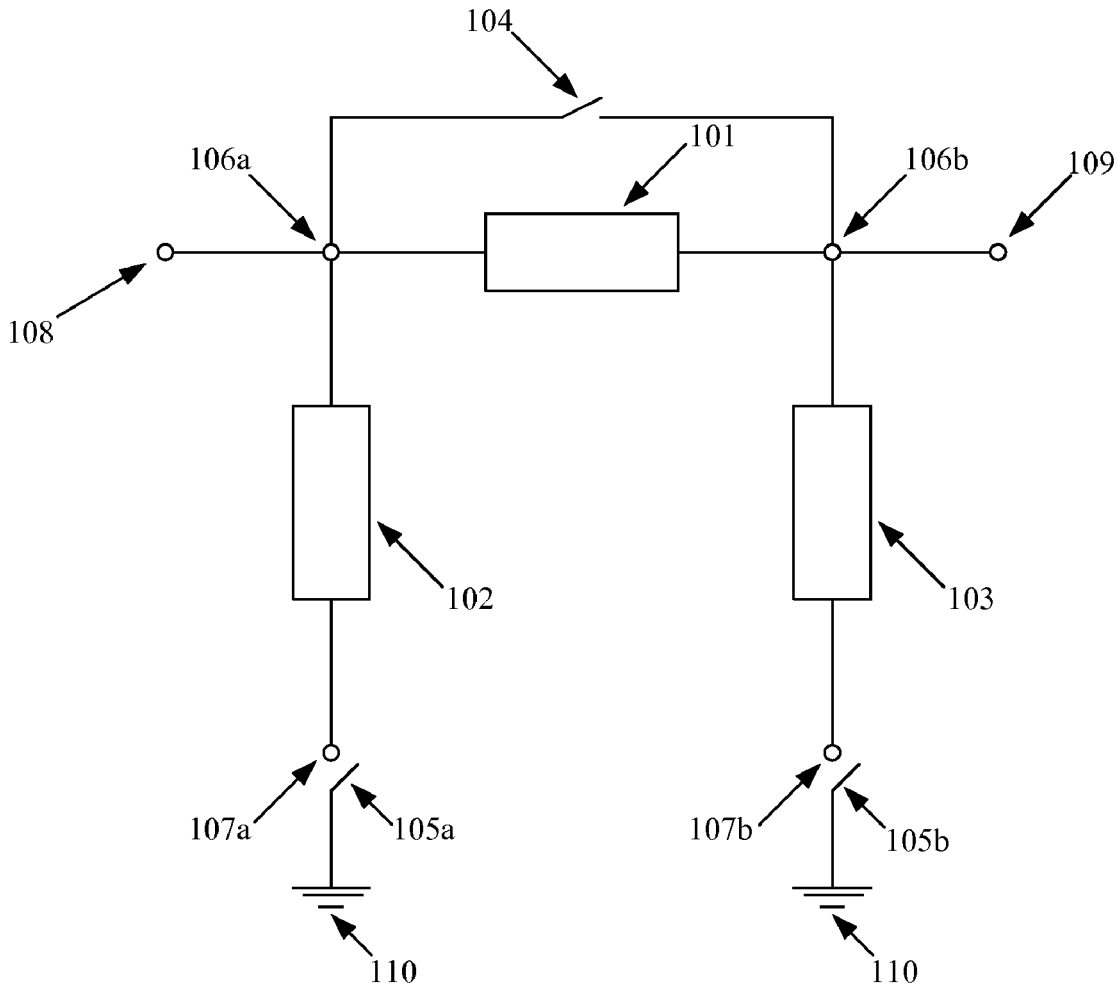
FIG. 1 is a schematic diagram of a variable attenuator of a first embodiment of the invention.

As shown in FIG. 1, a first parallel switch 104 is parallel connected between both terminals 106*a* and 106*b* of a first serial resistor 101. A first serial switch 105*a* is serially connected between a first parallel resistor 102 and a common grounded end 110. A second serial switch 105*a* is serially connected between a second parallel resistor 103 and the common grounded end 110. As the first parallel switch 104 is switched off and the first serial switch 105*a* and the second serial switch 105*b* are switched on, the variable attenuator is a π-type attenuator circuit having required attenuation.

As the first parallel switch 104 is switched on and the first serial switch 105*a* and the second serial switch 105*b* are switched off, attenuation of the variable attenuator is 0 dB, and thus variation of attenuation of the variable attenuator is implemented. At this time, the first parallel resistor 102 and the second parallel 103 can be regarded as being hang on the main signal circuit. However, since the first parallel resistor 102 and the second parallel 103 are in a high-resistance state for a RF circuit, their effect on the main signal circuit is neglectable.

Figure 2:
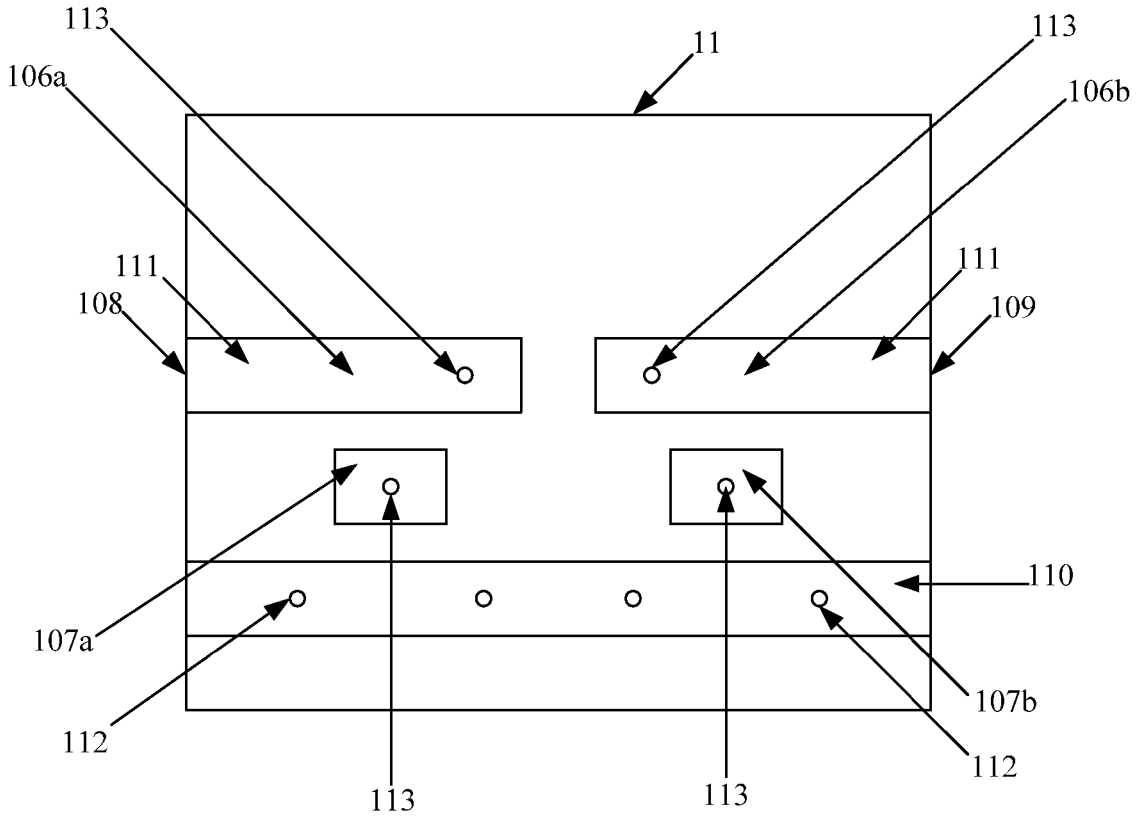
FIG. 2 is a schematic view of a surface layer of a substrate of a variable attenuator of a first embodiment of the invention.

As shown in FIG. 2, it should be noted that only parts of components relevant to this embodiment are illustrated for the purpose of clear explanation.

In this embodiment, a substrate 11 is a RF PCB board. In other embodiment, the substrate 11 can be a ceramic substrate with better heat dissipation and heat tolerance performance. For convenient adjusting and layout, and easy transmission of RF signals, in this embodiment, substrate 11 is a four-layer PCB board. In other embodiment, other number of layers, such as one, two or more may be used. A first layer of the substrate 11 is a surface layer, and a signal input end 108, a signal output end 109, a signal microstrip line 111, both terminals 106*a* and 106*b* of the first serial resistor 101, an terminal 107*a* of the first parallel resistor 102, an terminal 107*b* of the second parallel resistor 103, and the common grounded end 110 are disposed on the surface layer. Two intermediate layers are metal grounded layers, and are connected to the common grounded end 110 on the surface layer and the bottom layer via a grounded through hole 112. The signal input end 108 is connected to the terminal 106*a* via the signal microstrip line 111, the terminal 106*a* is connected to the terminal 106*a* on the bottom layer via a signal through hole 113, the signal output end 109 is connected to the terminal 106*b* via the signal microstrip line 111, the terminal 106*b* is connected to the terminal 106*b* on the bottom layer via the signal through hole 113, the ends 107*a* and 107*b* are respectively connected to the ends 107*a* and 107*b* on the bottom layer via the signal through hole 113, and the signal through hole 113 is not connected to the metal grounded layers. The first serial resistor 101, the first parallel resistor 102, and the second parallel resistor 103 are disposed on the bottom layer.

Figure 3:
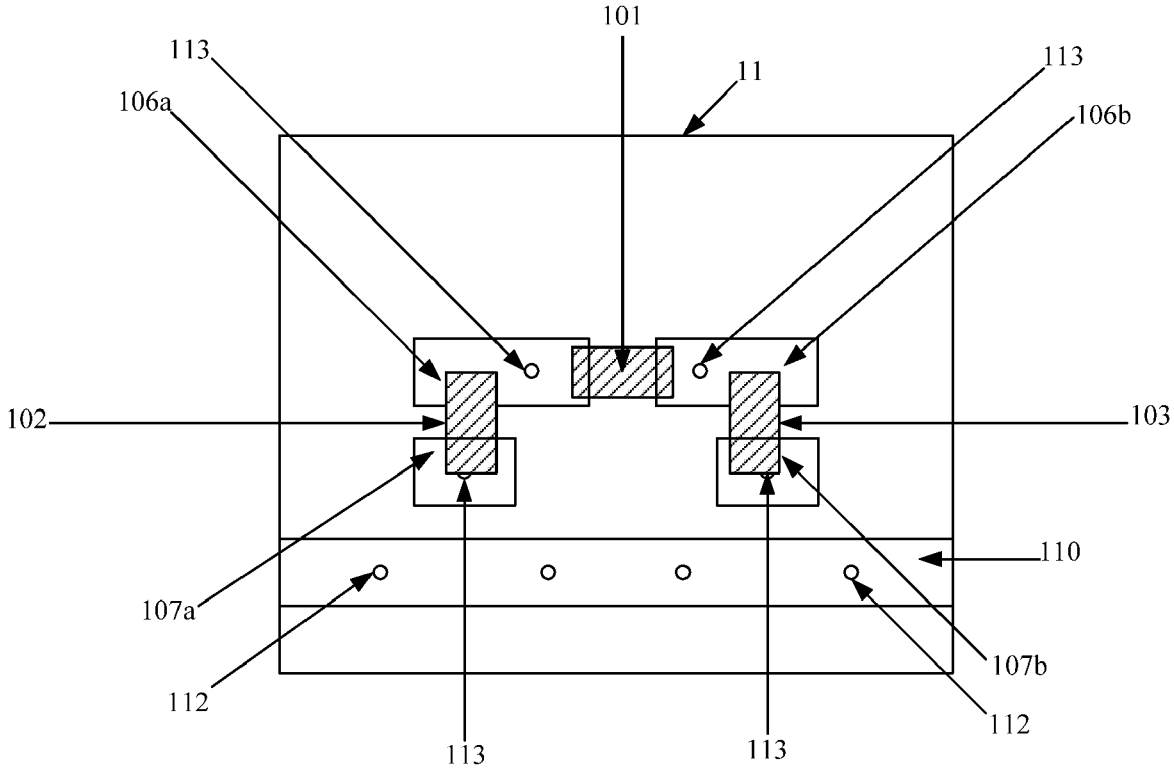
FIG. 3 is a schematic view of a bottom layer of a substrate of a variable attenuator of a first embodiment of the invention.

As shown in FIG. 3, it should be noted that only parts of components relevant to this embodiment are illustrated for the purpose of clear explanation.

A first serial resistor 101 is disposed on a bottom layer of a substrate 11. Both ends of the first serial resistor 101 are connected to ends 106*a* and 106*b* on the bottom layer. A first parallel resistor 102 and a second parallel resistor 103 are disposed on the bottom layer of the substrate 11. One end of the first parallel resistor 102 is connected to the terminal 106*a*, and the other end thereof is connected to the terminal 107*a*. One end of the second parallel resistor 103 is connected to the terminal 106*b*, and the other end thereof is connected to the terminal 107*b*.

To prevent solder tin or welding oil penetrating a signal through hole 113 or a grounded through hole 112 from affecting terminals on the surface layer during automatic welding, solder mask is used to cover the signal through hole 113 or the grounded through hole 112.

Figure 4:
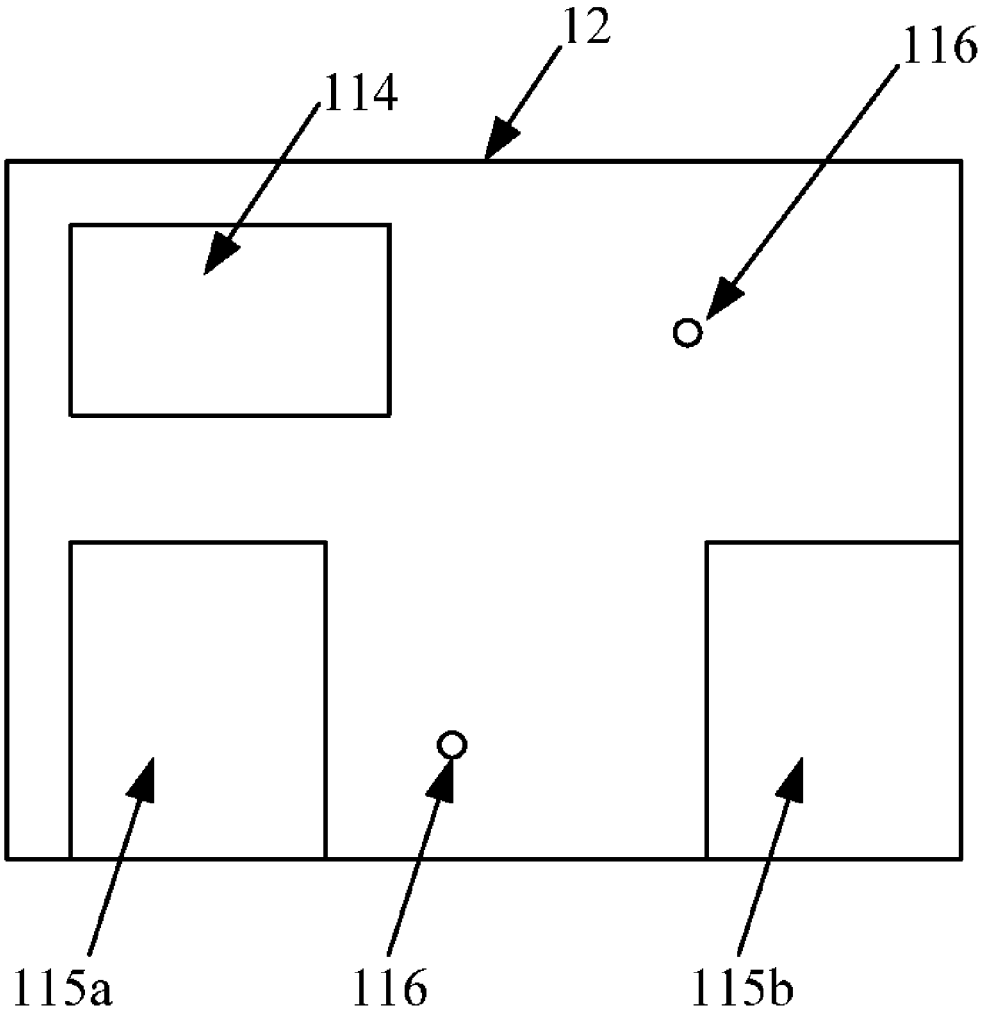
FIG. 4 is a schematic view of a switch of a variable attenuator of a first embodiment of the invention.

As shown in FIG. 4, the switch of the variable attenuator is a toggle switch implemented via a conductive sheet, so as to save cost and to make it possible for the first parallel resistor, the second parallel resistor and the first serial resistor to be smoothly connected to the main signal circuit as the first parallel switch, the first serial switch and the second serial switch are switched. A width of the conductive sheet is the same as a bandwidth whereby obtaining an optimum attenuation. In another embodiment, the switch may be a rotary switch implemented by a conductive sheet. The conductive sheets are made of conductive materials such as conductors, and disposed on the same insulator 12 so that the first parallel switch, the first serial switch and the second serial switch operate simultaneously. In another embodiment, the first parallel switch, the first serial switch and the second serial switch are disposed on different insulators.

The insulator 12 is a single-layered PCB board. In other embodiments, the insulator 12 is made of plastics, ceramics and so on. Three conductive sheets 114, 115*a* and 115*b* are disposed on the insulator 12. The conductive sheet 114 operates as a switch of the first serial resistor 101, the conductive sheet 115*a* operates as a switch of the first parallel resistor 102, and the conductive sheet 115*b* operates as a switch of the second parallel resistor 103. A transition hole 116 operates to move the PCB board.

Figure 5:
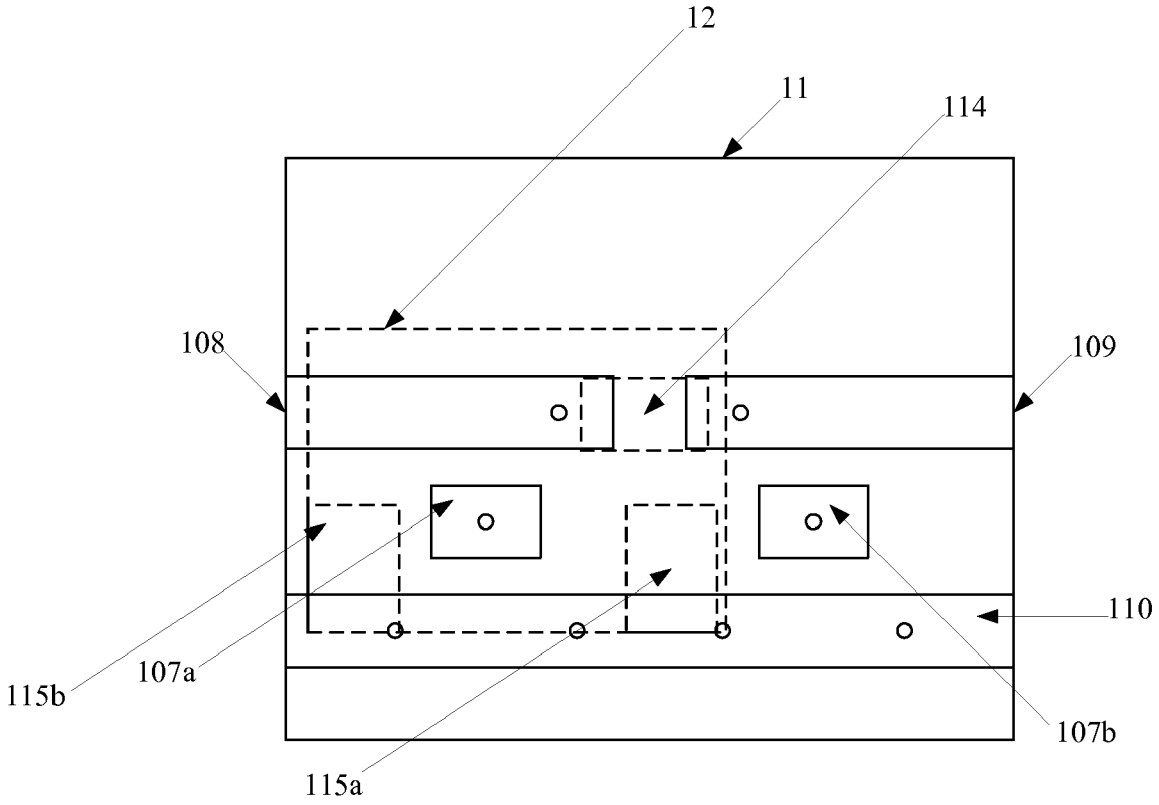
FIG. 5 illustrates a combination of a switch in FIG. 4 with a substrate.

As shown in FIG. 5, a first serial switch and a second serial switch on the PCB board, and a first parallel resistor, a second parallel resistor and a first serial resistor on the bottom layer of the substrate can be disposed on the same layer or different layers. In this embodiment, the first parallel switch, the first serial switch and the second serial switch on the PCB board, and the first parallel resistor, the second parallel resistor and the first serial resistor on the bottom layer of the substrate are disposed on different layers.

As shown in FIGS. 1 and 5, a part indicated by a dashed line illustrates a PCB board in FIG. 4 (rotating by 180 degrees) on the substrate 11. A side of the PCB board on which the metal conductive sheet is disposed is contacted with the surface layer of the substrate 11. The first serial resistor 101 is shortened by the conductive sheet 114, namely the first parallel switch 104 parallel connected to the first serial resistor 101 is switched on. At this time, the conductive sheets 115*a* and 115*b* are not contacted with the terminals 107*a* and 107*b*, namely the first serial switch 105*a* and the second serial switch 105*b* respectively serially connected to the first parallel resistor 102 and the second parallel resistor 103 are switched off, and attenuation of the variable attenuator is 0 dB.

When moving the PCB board 12 so that the conductive sheet 114 detaches from the terminal 106*a* of the first serial resistor 101, namely the first parallel switch 104 parallel connected to the first serial resistor 101 is switched off, the conductive sheet 115*a* connects the terminal 107*a* to the common grounded end 110, namely the first serial switch 105*a* serially connected to the first parallel resistor 102 is switched on, and the conductive sheet 115*b* connects the terminal 107*b* to the common grounded end 110, namely the second serial switch 105*b* serially connected to the second parallel resistor 103 is switched on. At this time, attenuation of the variable attenuator is equal to a predetermined value, and thus variation of the attenuation is realized, and the process is reversible.

Figure 6:
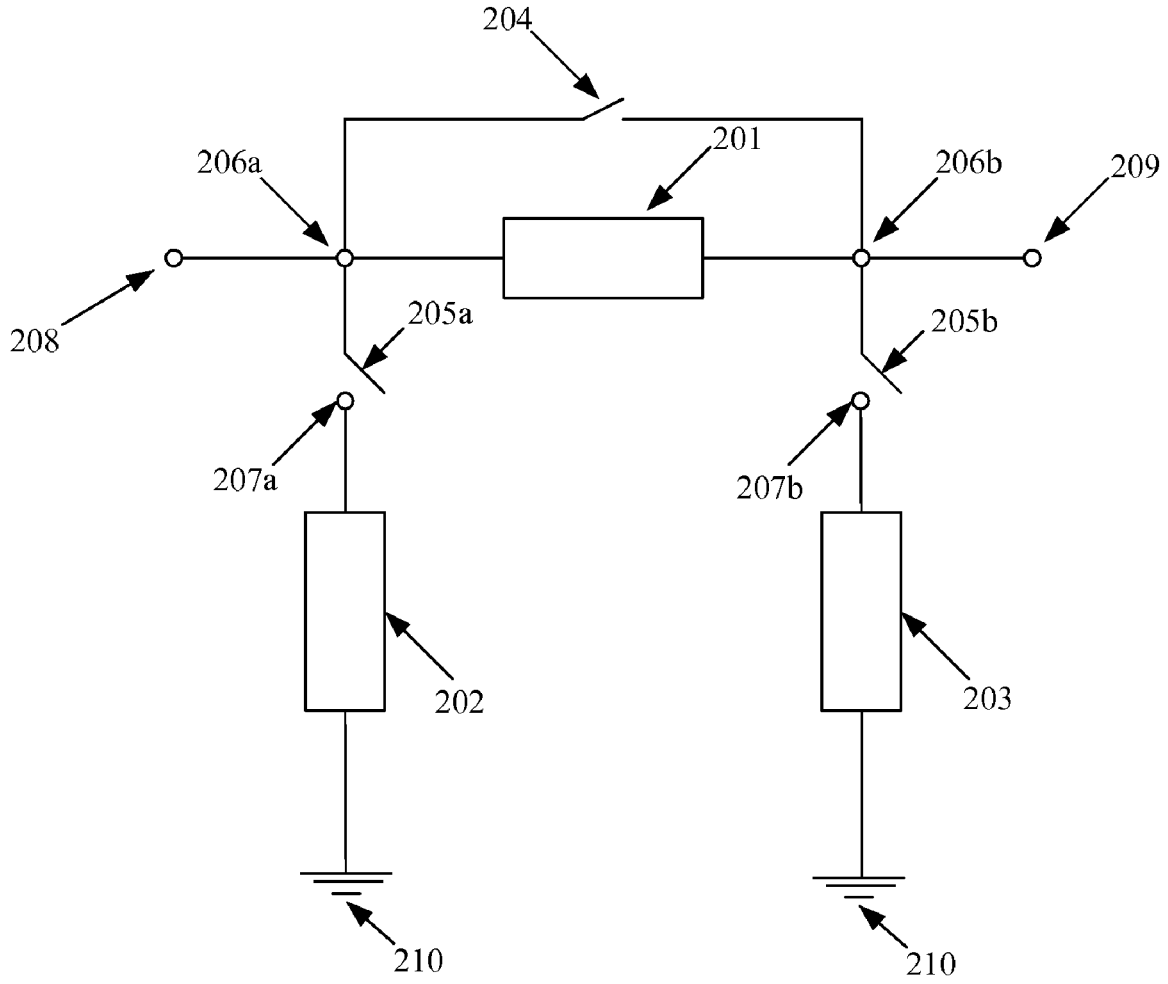
FIG. 6 is a schematic diagram of a variable attenuator of a second embodiment of the invention.

As shown in FIG. 6, the variable attenuator of a second embodiment of the invention is almost the same as that of a first embodiment thereof, except that a first serial switch 205*a* is not disposed between a first parallel resistor 202 and a common grounded end 210, but on the other end of the first parallel resistor 202, and a second serial switch 205*b* is not disposed between a second parallel resistor 203 and the common grounded end 210, but on the other end of the second parallel resistor 203, whereby facilitating variation of attenuation of the variable attenuator.

Figure 7:
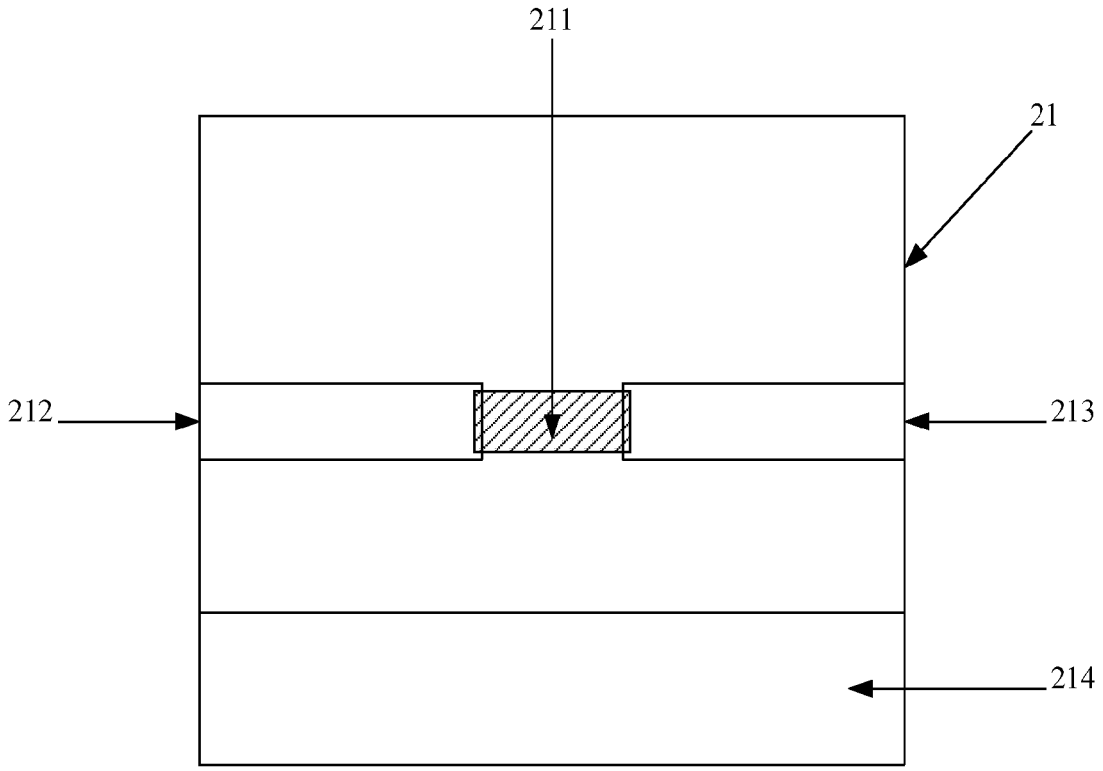
FIG. 7 is a schematic view of a surface layer of a first substrate of a variable attenuator of a second embodiment of the invention.

As shown in FIG. 7, it should be noted that only parts of components relevant to this embodiment are illustrated for the purpose of clear explanation.

An attenuation circuit is disposed on a substrate 21, and an insulator operating as a switch. In this embodiment, the substrate 21 is a ceramic substrate that features good RF performance and heat tolerance performance and makes it possible to dispose a film resistor (a thin film resistor or a thick film resistor) thereon. In other embodiments, other types of substrates can be used.

A first serial resistor 211 and a common grounded end 214 are disposed on the substrate 21, and both ends of the first serial resistor 211 are respectively connected to a signal input end 212 and a signal output end 213. A thickness of the first serial resistor 211 is slightly less than that of a signal microstrip line. In another embodiment, the first serial resistor 211 is disposed on a bottom layer of the substrate 21.

Figure 8:
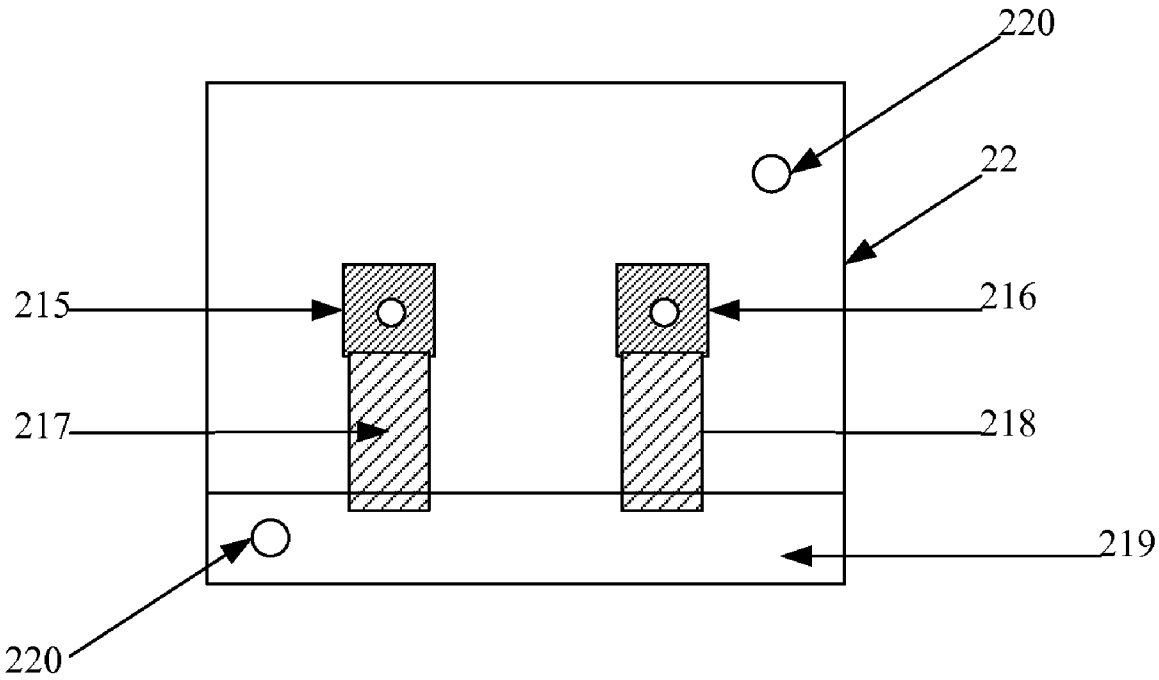
FIG. 8 is a schematic view of a surface layer of a first switch of a variable attenuator of a second embodiment of the invention.

As shown in FIG. 8, it should be noted that only parts of components relevant to this embodiment are illustrated for the purpose of clear explanation.

In order to improve precision of the variable attenuator and to reduce affect of the first parallel resistor 217 and the second parallel resistor 218 on the main signal circuit, the first parallel resistor 217, the second parallel resistor 218 and a pair of conductive sheet 215 and 216 are disposed on the same insulator 22. The insulator 22 is a double-layered ceramic substrate having better heat dissipation performance than a PCB board. In other embodiment, the insulator 22 is made of plastic rubber, a PCB board and so on.

The first parallel resistor 217 and the second parallel resistor 218 are disposed on a surface layer of the ceramic substrate, the conductive sheet 215 operating as a first serial switch is connected to one end of the first parallel resistor 217, the conductive sheet 216 operating as a second serial switch is connected to one end of the second parallel resistor 218. The other end of the first parallel resistor 217 and that of the second parallel resistor 218 are connected to the common grounded end 219.

Figure 9:
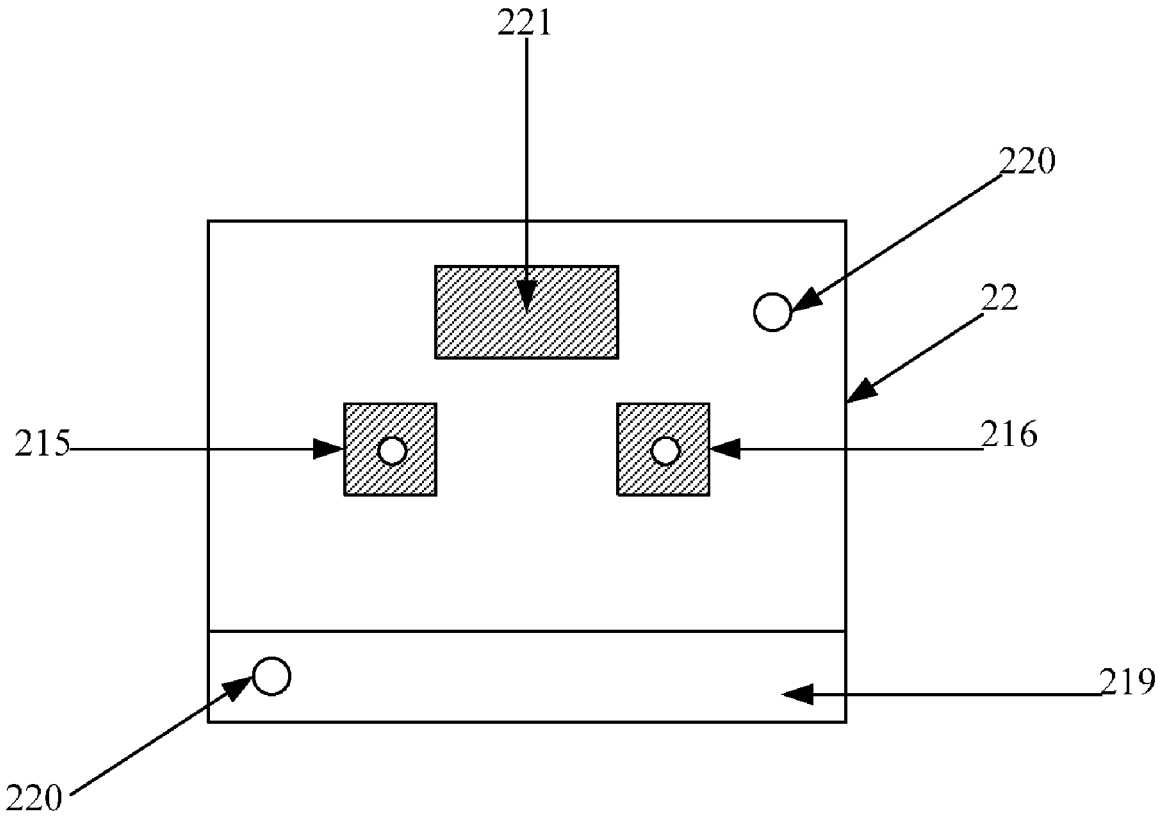
FIG. 9 is a schematic view of a bottom layer of a first switch of a variable attenuator of a second embodiment of the invention.

As shown in FIG. 9, multiple conductive sheets 221, 215 and 216, and a transition hole 220 are disposed on a bottom layer of the ceramic substrate. The conductive sheet 221 operates to shorten the first serial resistor 211, and the conductive sheets 215 and 216 are connected to the ceramic substrate via through holes 220.

Figure 10:
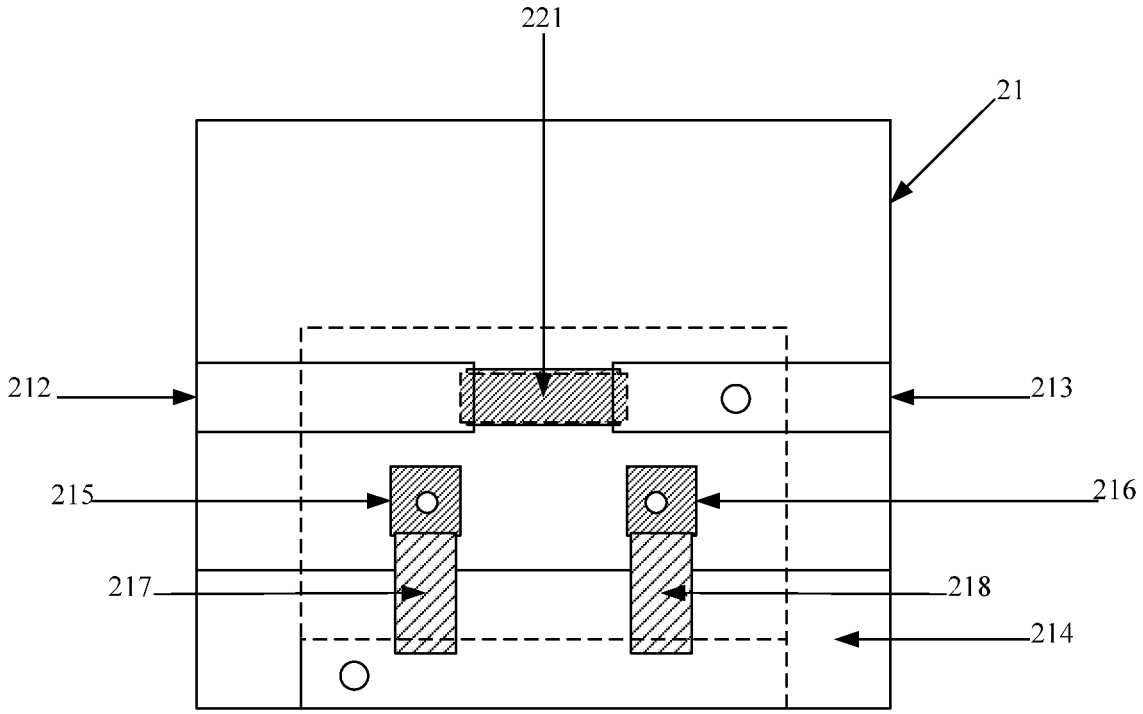
FIG. 10 illustrates a first combination of a first switch in FIGS. 8 and 9 with a surface layer of a first substrate.

As shown in FIG. 10, the bottom layer of the ceramic substrate is contacted with a surface layer of the substrate 21 in FIG. 7. The conductive sheet 221 shortens the first serial resistor 211, and the first parallel resistor 217, the second parallel resistor 218, the first serial switch 215, and the second serial switch 216 are disconnected from the main signal circuit. At this time, attenuation of the variable attenuator is 0 dB.

Figure 11:
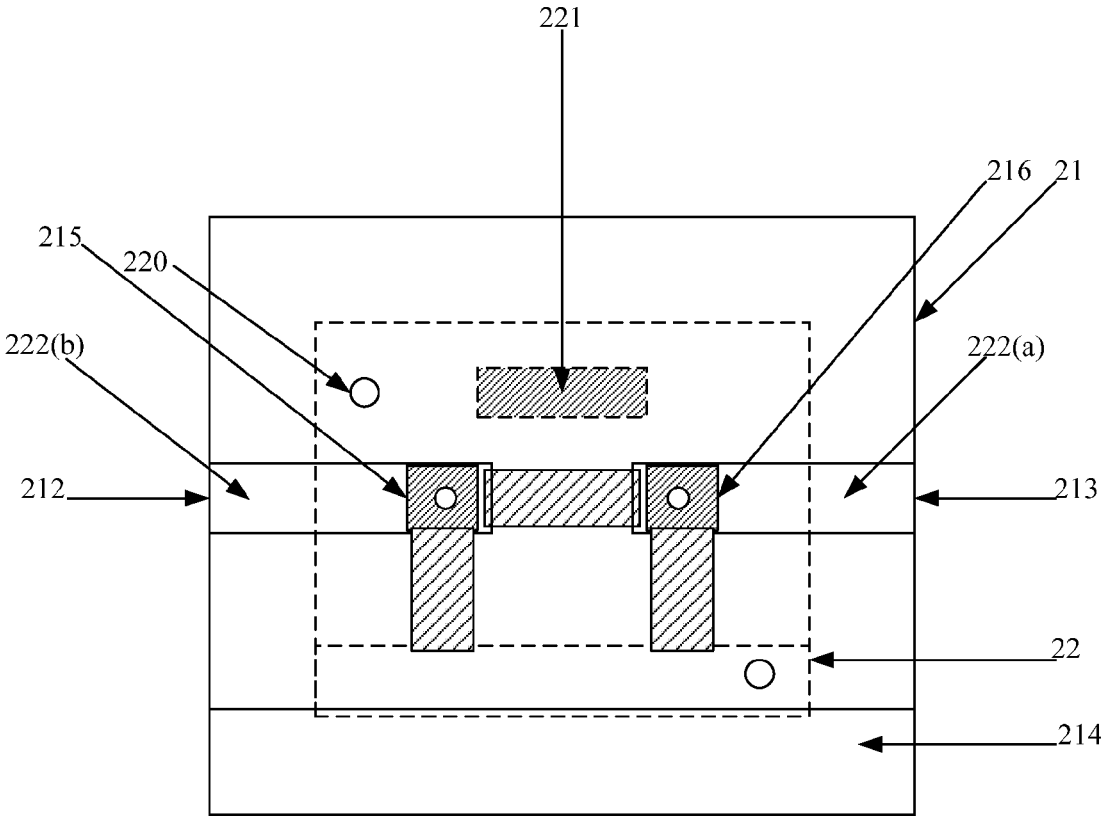
FIG. 11 illustrates a second combination of a first switch in FIGS. 8 and 9 with a surface layer of a first substrate.

As shown in FIG. 11, by moving the ceramic substrate via the transition hole 220 so that the conductive sheet 221 detaches from the first serial resistor 211. At this time one end of the conductive sheet 215 is connected to a signal microstrip line 222(*b*) of the substrate 21 and to one end of the first serial resistor 211, one end of the conductive sheet 216 is connected to another signal microstrip line 222(*a*) of the substrate 21 and to the other end of the first serial resistor 211, and thus a π-type attenuator circuit is formed.

Figure 12:
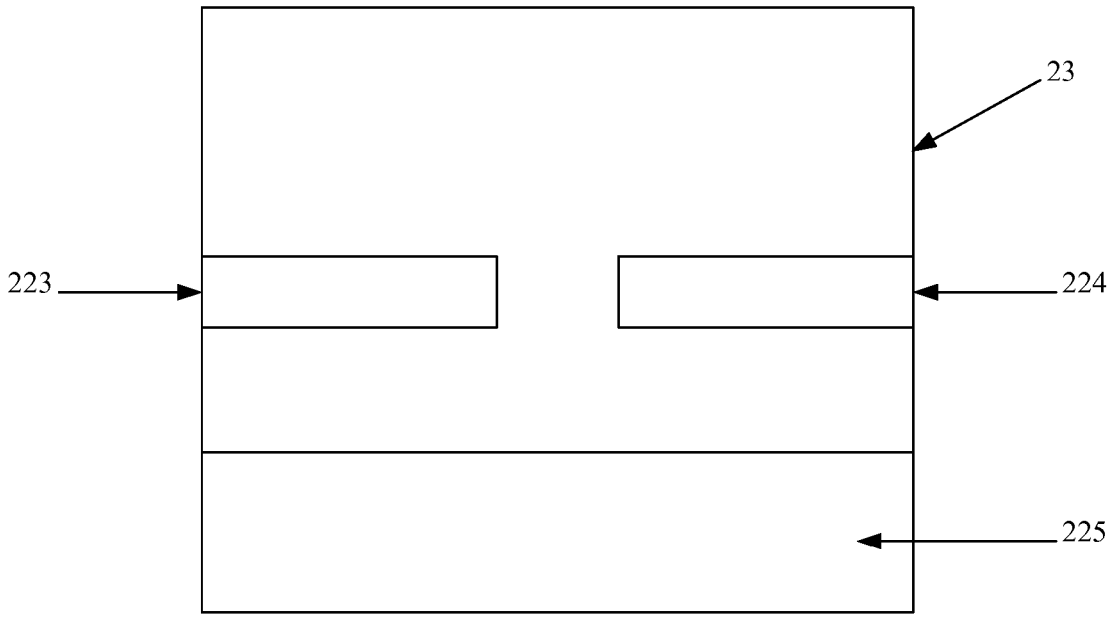
FIG. 12 is a schematic view of a surface layer of a second substrate of a second embodiment of the invention.

As shown in FIG. 12, it should be noted that only parts of components relevant to this embodiment are illustrated for the purpose of clear explanation.

An attenuation circuit is disposed on a substrate 23, and an insulator operating as a switch. In this embodiment, the substrate 23 is a ceramic substrate that features good RF performance and makes it possible to dispose a film resistor (a thin film resistor or a thick film resistor) thereon. In other embodiments, other types of substrates can be used.

A signal input end 223, a signal output end 224, and a common grounded end 225 are disposed on the substrate 23.

Figure 13:
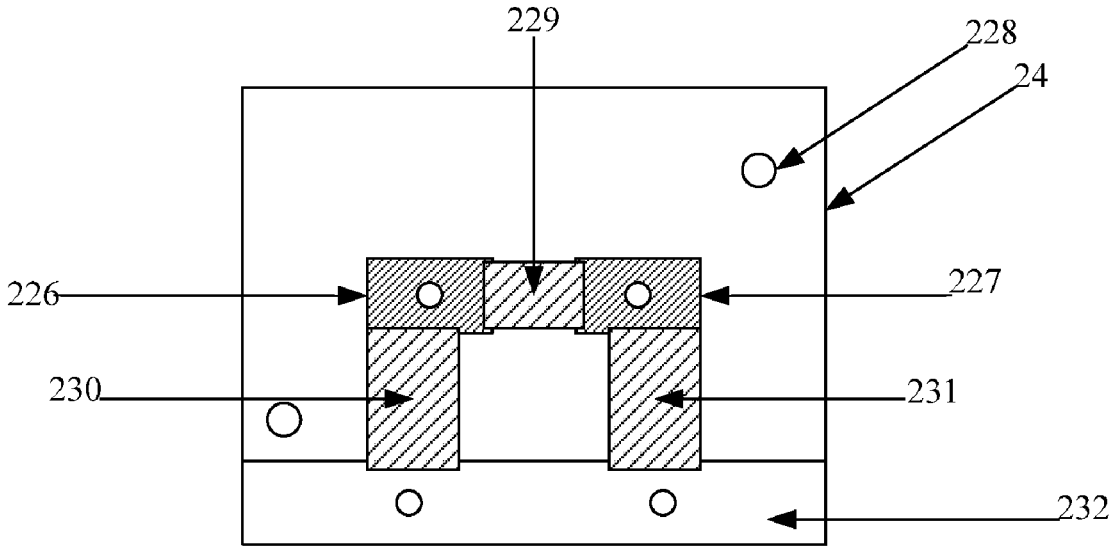
FIG. 13 is a schematic view of a surface layer of a second switch of a variable attenuator of a second embodiment of the invention.

As shown in FIG. 13, it should be noted that only parts of components relevant to this embodiment are illustrated for the purpose of clear explanation.

The first parallel resistor 230, the second parallel resistor 231 and a pair of conductive sheet 226 and 227 are disposed on the same insulator 24. The insulator 24 is a double-layered ceramic substrate or PCB board. In other embodiment, the insulator 24 is made of plastic rubber.

The first parallel resistor 230, the second parallel resistor 231, and the first serial resistor 229 are disposed on a surface layer of the insulator 24, one end of the first parallel resistor 230 is connected to the conductive sheet 226, one end of the second parallel resistor 231 is connected to the conductive sheet 227, the other end of the first parallel resistor 230 and that of the second parallel resistor 231 are connected to the common grounded end 232, and both ends of the first serial resistor 229 are respectively connected to the conductive sheets 226 and 227.

Figure 14:
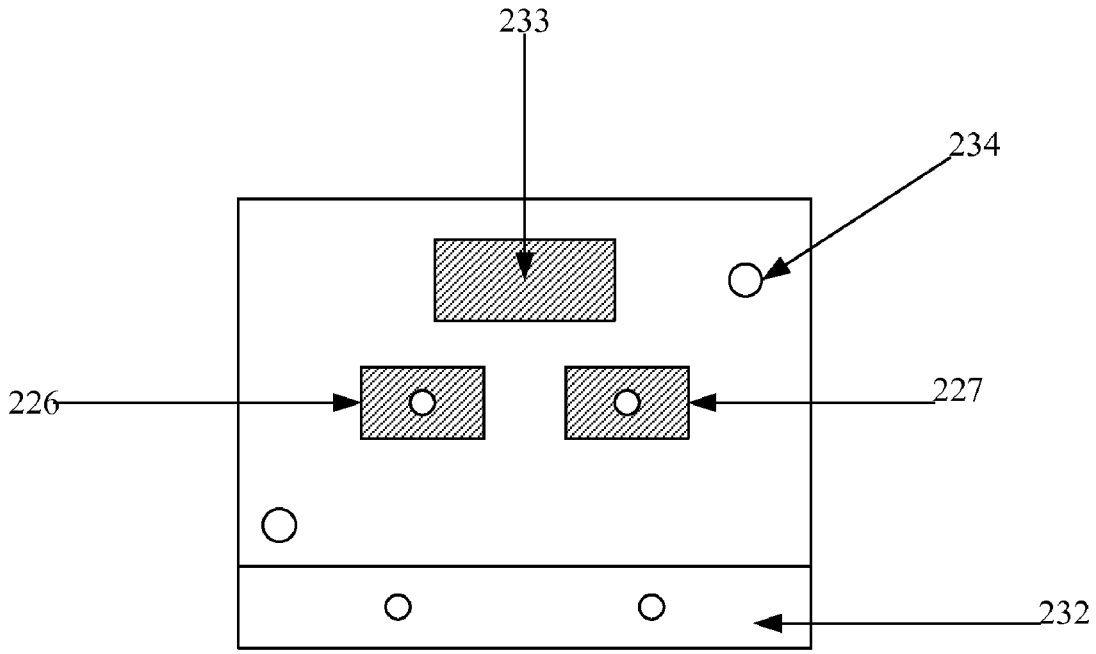
FIG. 14 is a schematic view of a bottom layer of a second switch of a variable attenuator of a second embodiment of the invention.

As shown in FIG. 14, multiple conductive sheets 226, 227 and 233, and a transition hole 234 are disposed on a bottom layer of the insulator 24. The conductive sheet 233 operates to shorten the first serial resistor 229, and the conductive sheets 226 and 227 are connected to the insulator 24 via through holes 234.

Figure 15:
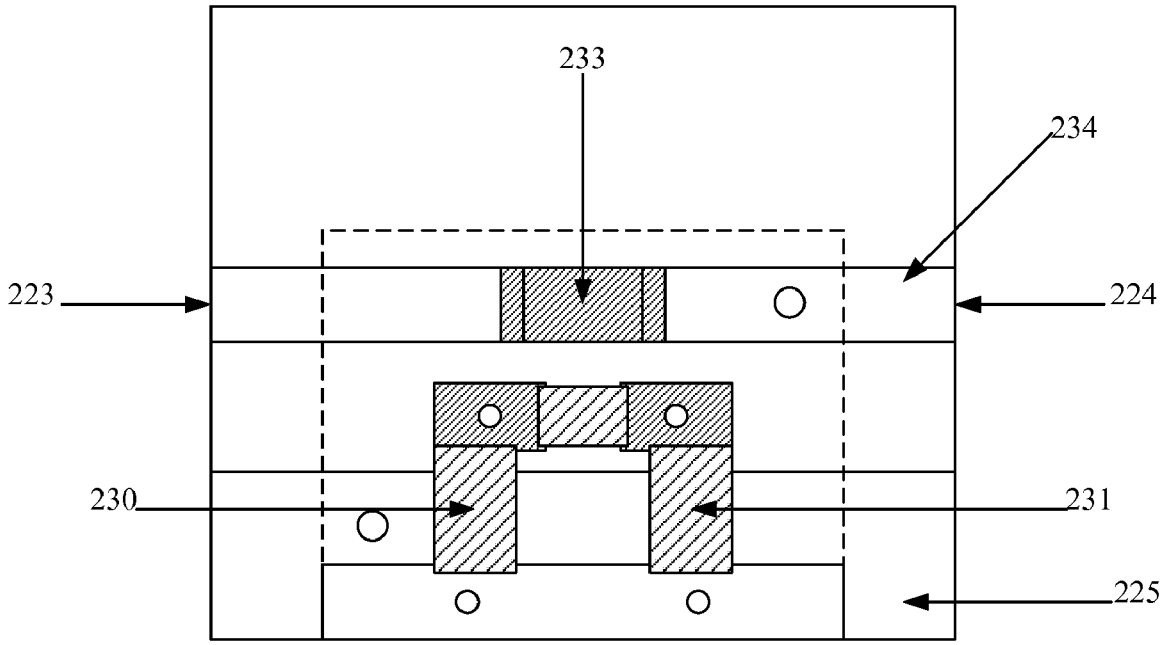
FIG. 15 illustrates a first combination of a second switch in FIGS. 13 and 14 with a surface layer of a second substrate.

As shown in FIG. 15, the bottom layer of the insulator 24 is contacted with a surface layer of the substrate 23 in FIG. 12. The conductive sheet 233 shortens the first serial resistor 229, and the first parallel resistor 230, the second parallel resistor 231, the first serial resistor 229, the first serial switch 226, and the second serial switch 227 are disconnected from the main signal circuit.

Figure 16:
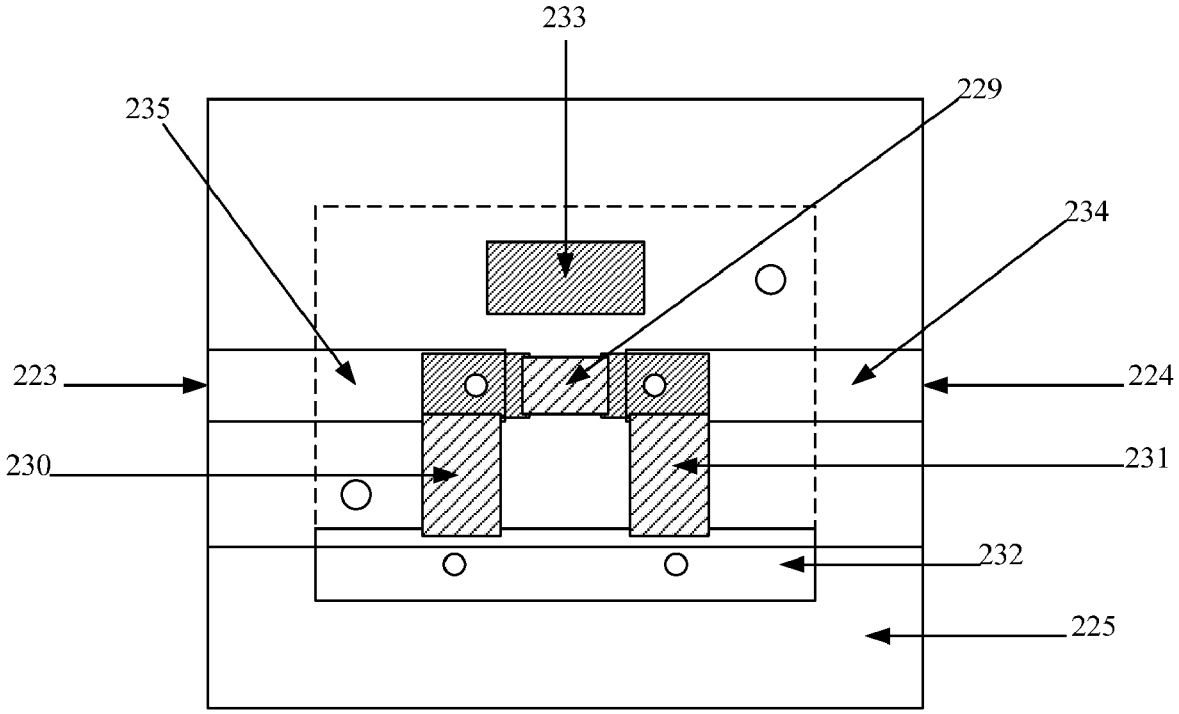
FIG. 16 illustrates a second combination of a second switch in FIGS. 13 and 14 with a surface layer of a second substrate.

As shown in FIG. 16, by moving the insulator 24 via the transition hole 234, the conductive sheet 233 is disconnected from the main signal circuit. At this time one end of the conductive sheet 226 is connected to a signal microstrip line 235 of the substrate 23, one end of the conductive sheet 227 is connected to another signal microstrip line 234 of the substrate 23, and thus the first serial resistor 211 is connected to the main signal circuit, the first parallel resistor 230 and the second parallel resistor 231 are connected to the main signal circuit, and a π-type attenuator circuit is formed. Moreover, to ensure that no signal interruption occurs and no signal reflection that may damage a circuit on a previous stage is generated during variation of attenuation of the attenuator, the conductive sheet 226 is connected to the signal microstrip line 235 and the conductive sheet 227 is connected to the signal microstrip line 234 before the conductive sheet 233 is disconnected from the signal microstrip lines 234 and 235.

The variable attenuator of a first embodiment of the invention has better heat dissipation performance and worse RF and attenuation performance than that of a second embodiment. Positions of resistors and materials of the substrate can be selected as required. Moreover, to facilitate better heat dissipation, heat conduct glue is added in the vicinity of the signal input end and the signal output end, or between the main signal circuit and the common grounded end, whereby facilitating heat dissipation and having no significant effect on RF performance of the attenuator.

A multi-stage π-type attenuator circuit can be obtained if multiple above-mentioned π-type attenuator circuits are serially connected, and a step amplitude of each stage can be freely set.

Switches on each stage of the multi-stage π-type attenuator circuit can be independent from each other, and disposed on at least one insulator (such as a PCB board). Preferably, switches parallel connected to serial resistors and those serially connected to parallel resistors are disposed on the same insulator.

Figure 17:
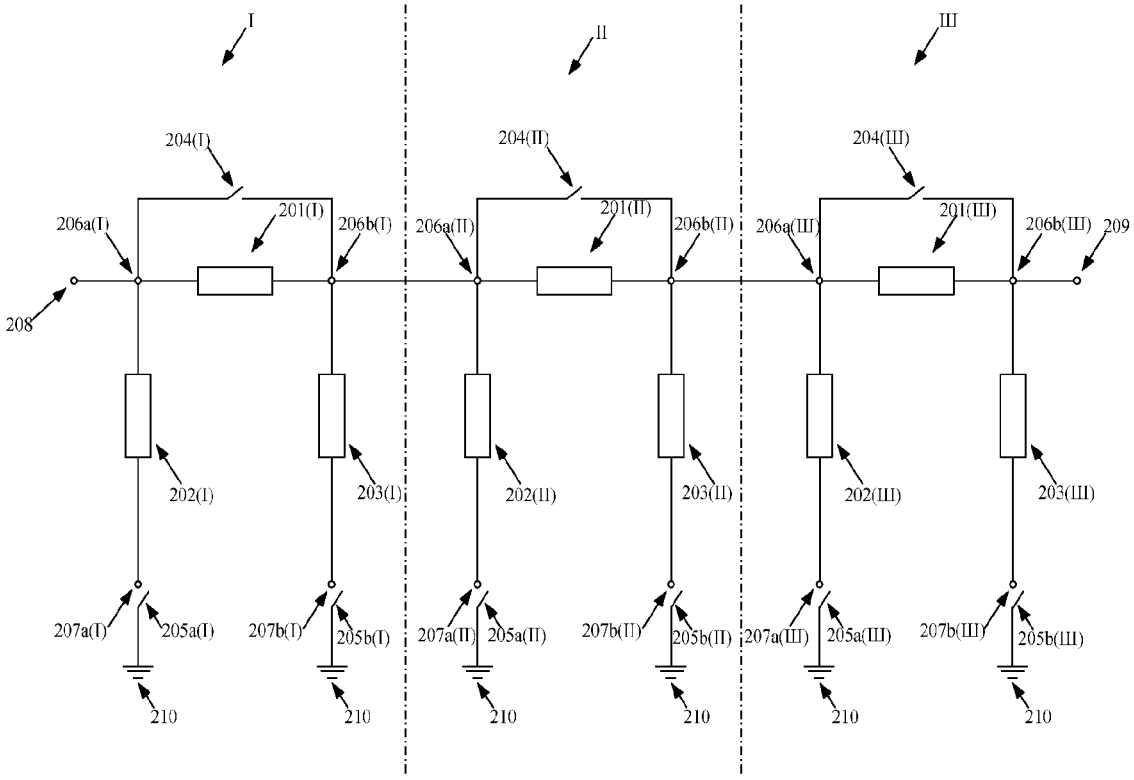
FIG. 17 is a schematic diagram of a variable attenuator of a third embodiment of the invention.

FIG. 17 illustrates a three-stage π-type attenuator circuit formed by three π-type attenuator circuits I, II and III. The circuit comprises a first first-stage serial resistor 201(I), a first second-stage serial resistor 201(II), a first third-stage serial resistor 201(III), a first first-stage parallel switch 204(I) disposed between two terminals 206*a*(I) and 206*b*(I) of the first first-stage serial resistor 201(I), a first second-stage parallel switch 204(II) disposed between two terminals 206*a*(II) and 206*b*(II) of the first second-stage serial resistor 201(II), a first third-stage parallel switch 204(III) disposed between two terminals 206*a*(III) and 206*b*(III) of the first third-stage serial resistor 201(III), a first first-stage parallel resistor 202(I), a second first-stage parallel resistor 203(I), a first second-stage parallel resistor 202(II), a second second-stage parallel resistor 203(II), a first third-stage parallel resistor 202(III), a second third-stage parallel resistor 203(III), a first first-stage serial switch 207*a*(I) disposed between the first first-stage parallel resistor 202(I) and a common grounded end 210, a second first-stage serial switch 207*b*(I) disposed between the second first-stage parallel resistor 203(I) and the common grounded end 210, a first second-stage serial switch 207*a*(II) disposed between the first second-stage parallel resistor 202(II) and the common grounded end 210, a second second-stage serial switch 207*b*(II) disposed between the second second-stage parallel resistor 203(II) and the common grounded end 210, a first third-stage serial switch 207*a*(III) disposed between the first third-stage parallel resistor 202(III) and the common grounded end 210, a second third-stage serial switch 207*b*(III) disposed between the second third-stage parallel resistor 203(III) and the common grounded end 210. Operation principle of each stage is the same as that in the first embodiment, and will not be described hereinafter. In this embodiment, all stages can be independent from each other, attenuation can be set freely or according to a fixed step amplitude. All the switches can be disposed on the same insulator (such as a PCB board), or on different insulators.

Since variable attenuators are widely used for adjusting power of a system, attenuation of 0 dB greatly affects the system, a fixed attenuator is added to a front end or a rear end, or between different stages of the variable attenuator.

In another embodiment, the first parallel resistor, the second parallel resistor, the first serial switch, the second serial switch, and the first parallel switch are disposed on the insulator, and the first serial resistor is disposed on the substrate, the principle is the same as the first embodiment, and will not be described hereinafter.

Figure 18:
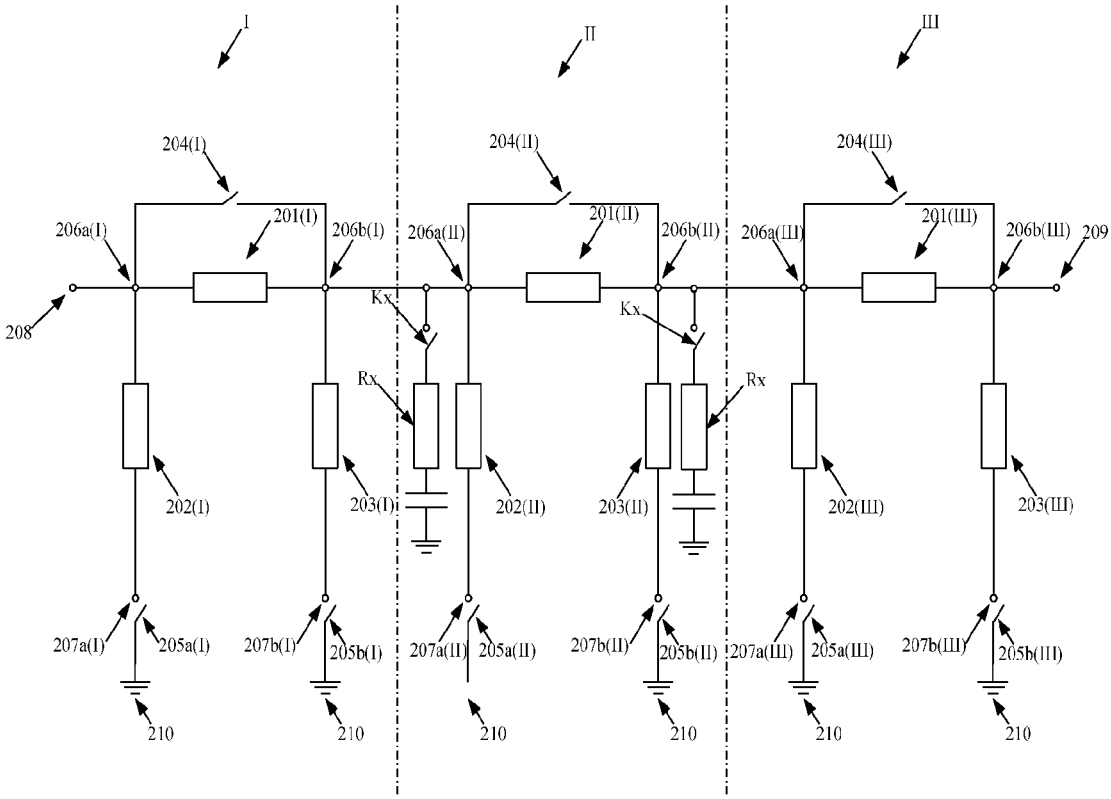
FIG. 18 is a schematic diagram of a variable attenuator in FIG. 17 with a correcting circuit.

For an attenuator with large attenuation (such as 0-60 dB), attenuation is constant as a radio frequency is below 4 GHz, and decreases the radio frequency exceeds 4 GHz. To solve this problem, a correcting circuit is added to the circuit in FIG. 17 (as shown in FIG. 18). Only parts of components relevant to this embodiment are illustrated for the purpose of clear explanation. In other embodiments, the correcting circuit can be added to other variable attenuators.

A correcting circuit is added to one end or both ends of the at least one-stage attenuator (the three-stage attenuator in this embodiment). The correcting circuit comprises a third parallel resistor Rx and a circuit switch Kx. One end of the third parallel resistor Rx is connected to the circuit switch Kx, and the other end thereof is connected to a microstrip terminal or to the ground. The microstrip terminal is equivalent to a capacitor or an inductor. The other end of the circuit switch Kx is connected to the signal input end or the signal output end, or between cascades of each stage on the main signal circuit, and operates along with the serial switch connected to the attenuator circuit.

In another embodiment, the correcting circuit comprises a third parallel resistor Rx, a circuit switch Kx, and a capacitor (or an inductor). One end of the correcting circuit is connected to the signal input end or the signal output end, or between cascades of each stage on the main signal circuit via the circuit switch Kx. The other end thereof is connected to the ground via the capacitor (or the inductor). The third parallel resistor Rx is connected between the circuit switch Kx and the capacitor (or the inductor), and operates along with the serial switch connected to the attenuator circuit. For example, the correcting circuit is disposed on an insulator (such as a PCB board) with one end thereof connected to a microstrip terminal (such as a microstrip line on the PCB board), and moves along with the insulator. In another embodiment, the other end thereof is connected to another circuit or the ground. As the parallel switch of the attenuator circuit is switched off, the circuit switch Kx is connected to the main signal circuit, and the microstrip terminal connected to the correcting circuit is not connected to any other circuits. At this time the microstrip terminal is equivalent to a RF capacitor or inductor.

The correcting circuit is capable of improving frequency performance and attenuation of the attenuator whereby increasing overall attenuation thereof. The correcting circuit is connected to both ends of an attenuator on a certain stage of the variable attenuator.

As shown in the equivalent circuit diagram in FIG. 18, the correcting circuit comprises the circuit switch Kx, the third parallel resistor, and the capacitor.

Figure 19:
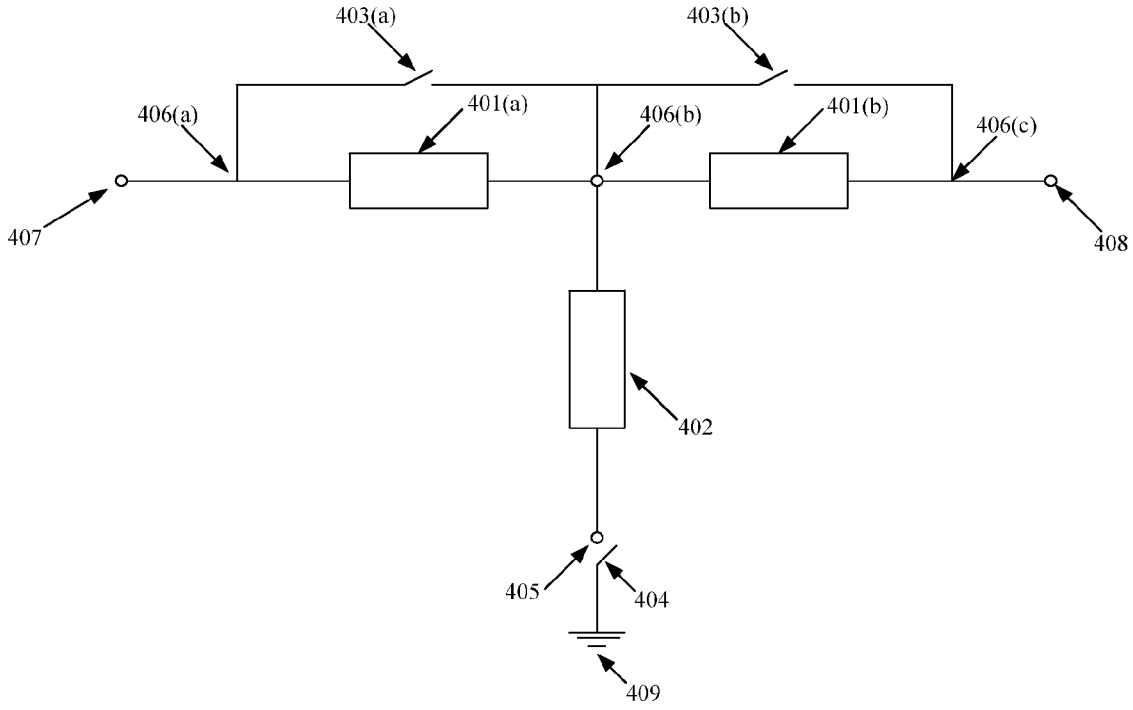
FIG. 19 is a schematic diagram of a variable attenuator of a fourth embodiment of the invention.

As shown in FIG. 19, a T-type attenuator circuit is illustrated. A first parallel resistor 403(*a*) is parallel connected between both terminals 406(*a*) and 406(*b*) of a first serial resistor 401(*a*), a second parallel switch 403(*b*) is parallel connected between both terminals 406(*b*) and 406(*c*) of a second serial resistor 401(*b*), and a first serial switch 404 is serially connected between a terminal 405 of the first parallel resistor 402 and a common grounded end 409. In other embodiment, the first serial switch 404 is serially connected to the other end of the first parallel resistor 402.

Figure 20:
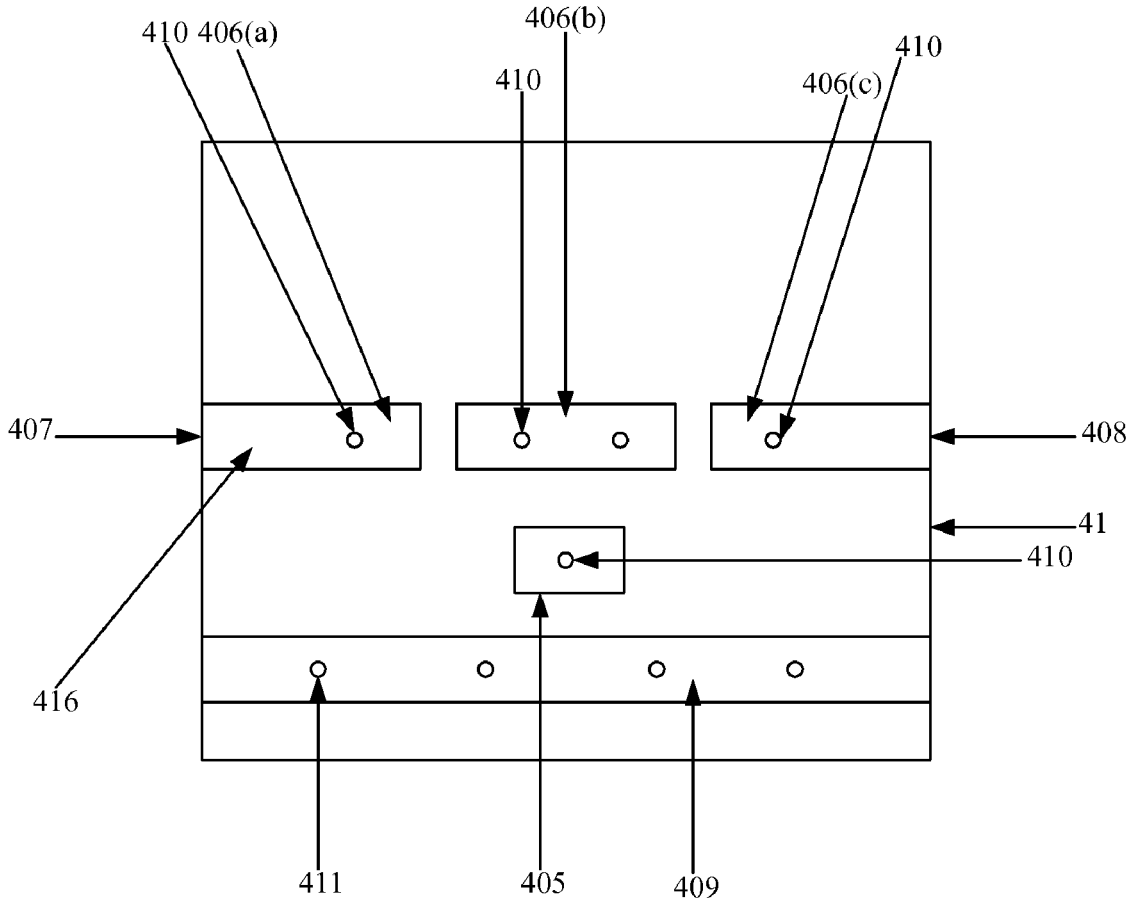
FIG. 20 is a schematic view of a surface layer of a substrate of a variable attenuator of a fourth embodiment of the invention.

As shown in FIG. 20, a substrate 41 is a four-layer RF PCB board. In other embodiments, other number of layers, such as one, two or more may be used, and the substrate 41 can be made of other materials such as ceramics. A first layer of the PCB board is a surface layer, a signal input end 407 on the surface layer is connected to a terminal 406(*a*) via a signal microstrip line 416, and a signal output end 408 is connected to a terminal 406(*c*) via the signal microstrip line 416. A pair of terminals 406(*a*) and 406(*b*) of a first serial resistor 401(*a*), a pair of terminals 406(*b*) and 406(*c*) of a second serial resistor 401(*b*), a terminal 405 of a first parallel resistor 402, a common grounded end 409, multiple terminals 406(*a*), 406(*b*), 406(*c*) and 405 are respectively connected to corresponding terminals on a bottom layer via a signal through hole 410. The common grounded end 409 is connected to a common grounded end on the bottom layer, and to two intermediate metal grounded layers via grounded through holes 411.

Figure 21:
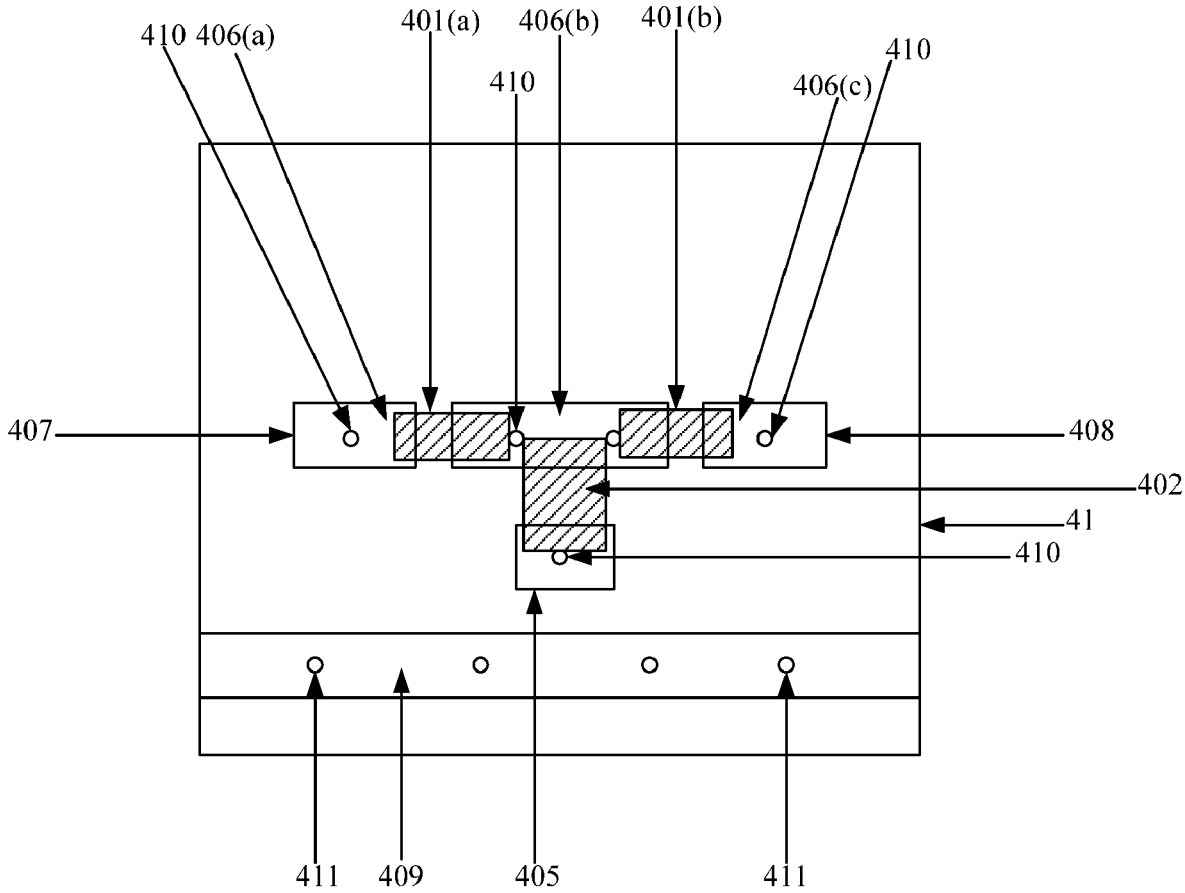
FIG. 21 is a schematic view of a bottom layer of a substrate of a variable attenuator of a fourth embodiment of the invention.

As shown in FIG. 21, a first serial resistor 401(*a*), a second serial resistor 401(*b*), and a common grounded end 409 are disposed on the bottom layer of the substrate 41, one end of the first serial resistor 401(*a*) is connected to the terminal 406(*a*), and the other end thereof is connected to the terminal 406(*b*). One end of the second serial resistor 401(*b*) is connected to the terminal 406(*b*), and the other end thereof is connected to the terminal 406(*c*). One end of the first parallel resistor 402 is connected to the terminal 406(*b*), and the other end thereof is connected to the terminal 405.

Figure 22:
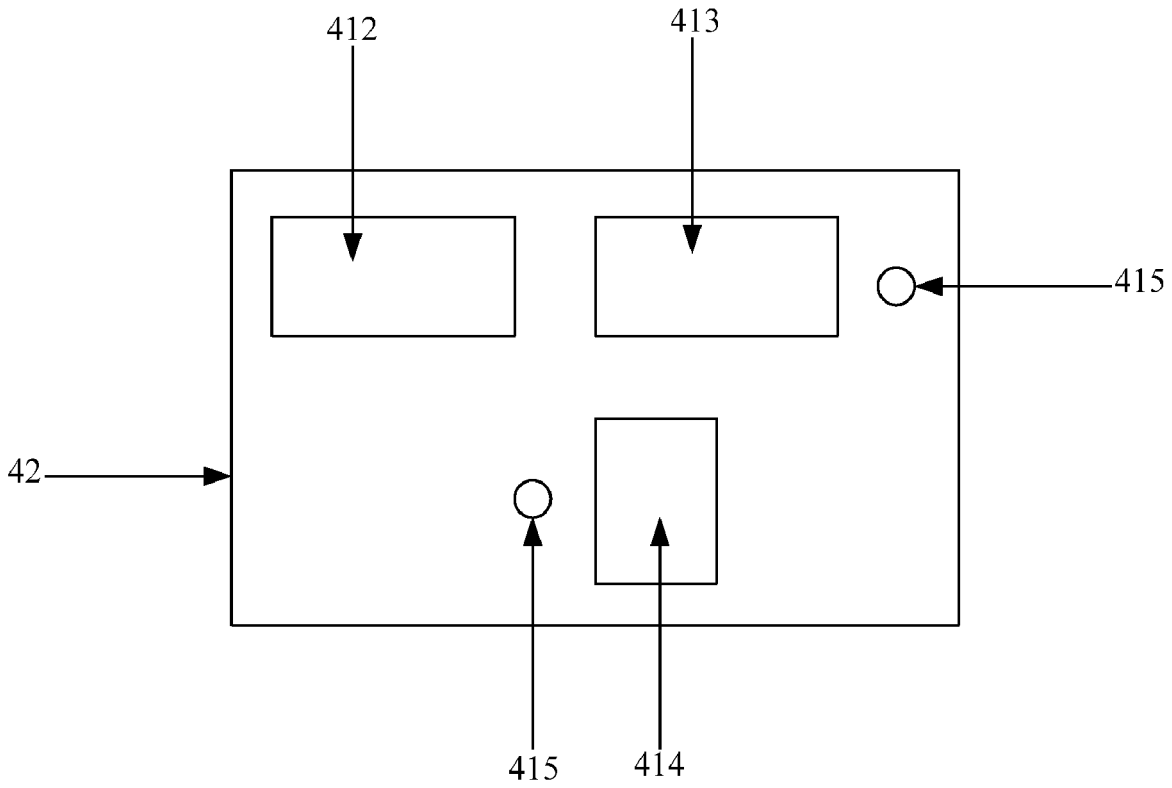
FIG. 22 is a schematic view of a switch of a variable attenuator of a fourth embodiment of the invention.

As shown in FIG. 22, the switch of the variable attenuator is a toggle switch implemented via a conductive sheet, so as to save cost and to make it possible for the first serial resistor, the second serial resistor and the first parallel resistor to be smoothly connected to the main signal circuit as the first parallel switch, the second parallel switch and the first serial switch are switched. A width of the conductive sheet is the same as a bandwidth whereby obtaining an optimum attenuation. In another embodiment, the switch may be a rotary switch implemented by a conductive sheet. The conductive sheets are made of conductive materials such as conductors, and disposed on the same insulator 42 so that the first parallel switch, the first serial switch and the second serial switch operate simultaneously. In another embodiment, the first parallel switch, the first serial switch and the second serial switch are disposed on different insulators.

The insulator 42 is a single-layered PCB board. In other embodiments, the insulator 42 is made of plastics, metal, ceramics and so on. Three conductive sheets 412, 413 and 414 are disposed on the insulator 42. The conductive sheet 413 operates as a first parallel switch of the first serial resistor 401(*a*), the conductive sheet 412 operates as a second parallel switch of the second serial resistor 401(*b*), and the conductive sheet 414 operates as a first serial switch of the first parallel resistor 402. A transition hole 415 operates to move the PCB board. A width of each of the conductive sheets 412 and 413 is the same as that of a signal microstrip line, and the conductive sheets 412 and 413 should be long enough to shorten the first serial resistor and the second serial resistor, respectively.

Figure 23:
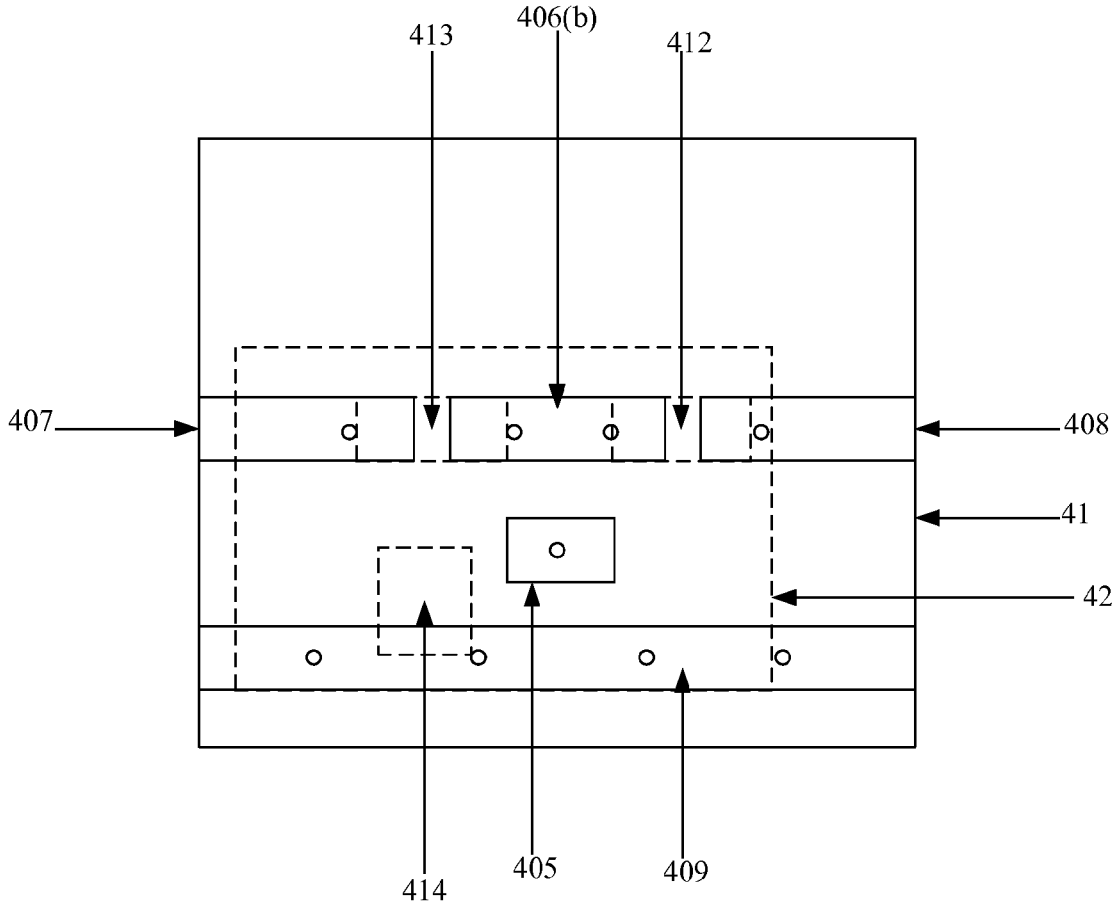
FIG. 23 illustrates a combination of the switch in FIG. 22 with a substrate.

As shown in FIG. 23, a first parallel switch, a second parallel switch and a first serial switch on the PCB board, and a first parallel resistor, a first serial resistor and a second serial resistor on the bottom layer of the substrate can be disposed on the same layer or different layers. In this embodiment, the first serial switch, and the first parallel resistor, the first serial resistor and the second serial resistor on the bottom layer of the substrate can be disposed on different layers.

A part indicated by a dashed line illustrates a PCB board in FIG. 22 (rotating by 180 degrees) on the substrate 41. A side of the PCB board on which the metal conductive sheet is disposed is contacted with the surface layer of the substrate 41. The terminals 406(*a*) and 406(*b*) are shortened by the conductive sheet 413, namely the parallel switch parallel connected to the first serial resistor 401(*a*) is switched on, and the terminals 406(*b*) and 406(*c*) are shortened by the conductive sheet 412, namely the parallel switch parallel connected to the second serial resistor 401(*b*) is switched on. At this time, the conductive sheets 414 are not contacted with the terminal 405, namely the serial switch 404 is switched off, and attenuation of the variable attenuator is 0 dB.

When moving the PCB board so that the conductive sheet 413 detaches from the terminal 406(*a*) and the conductive sheet 412 detaches from the terminal 406(*b*), namely switches connected to the first serial resistor 401(*a*) and the second serial resistor 401(*b*) are switched off. At this time, the conductive sheet 414 is contacted with the terminal 405, namely the serial switch connected to the first parallel resistor 402 is switched on, attenuation of the variable attenuator is equal to a predetermined value, and thus variation of the attenuation is realized, and the process is reversible.

A multi-stage T-type attenuator circuit can be obtained if multiple above-mentioned T-type attenuator circuits are serially connected, switches on each stage of the multi-stage T-type attenuator circuit can be independent from each other, and disposed on at least one insulator (such as a PCB board). The principle is the same as the second embodiment.

In another embodiment, the first parallel resistor, the first serial switch, the first parallel switch, and the second parallel switch are disposed on the insulator, and the first serial resistor and the second serial resistor are disposed on the substrate. The principle is the same as the first embodiment, and will not be described hereinafter.

Figure 24:
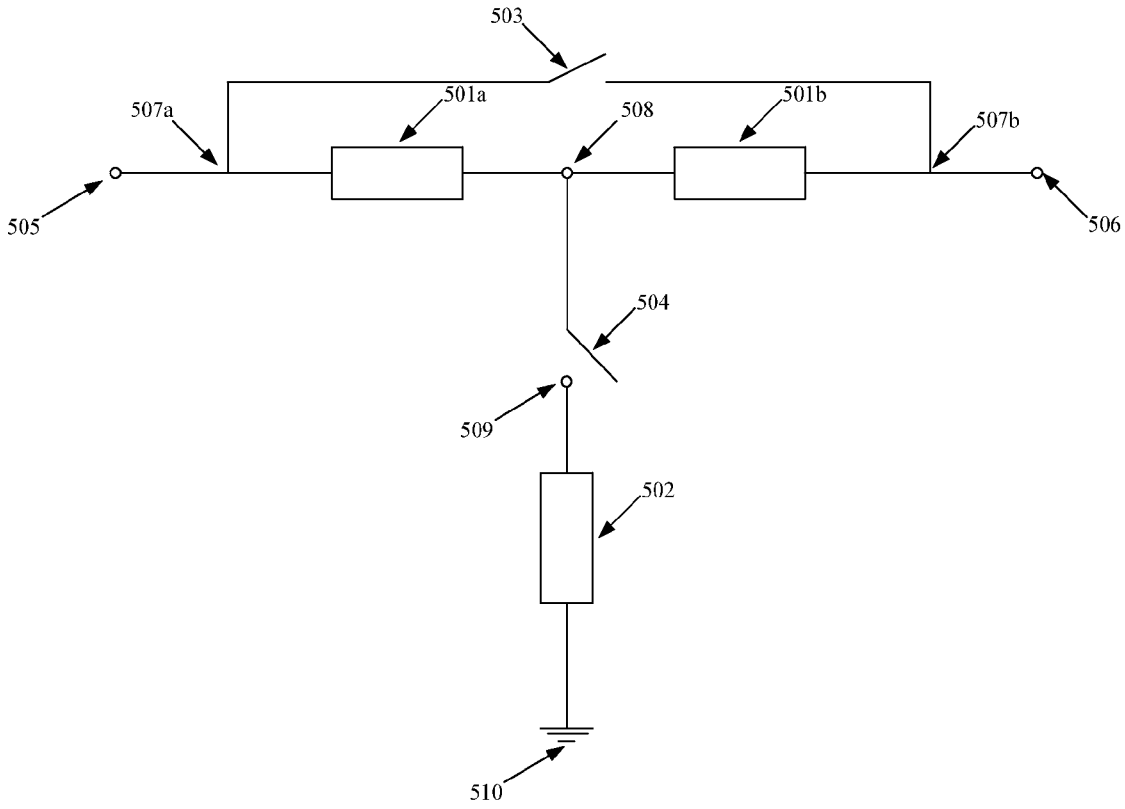
FIG. 24 is a schematic diagram of a variable attenuator of a fifth embodiment of the invention.

As shown in FIG. 24, a first parallel switch 503 is parallel connected between one end of the first serial resistor 501*a* and one end of the second serial resistor 501*b*. The first parallel switch 503 is the same as the switches 412 and 413 in FIG. 19. A first serial switch 504 is serially connected between terminals 508 and 509 of the first parallel resistor 502. In another embodiment, the switch 504 is serially connected to the other end of the first parallel resistor 502.

A multi-stage T-type attenuator circuit can be obtained if multiple above-mentioned T-type attenuator circuits are serially connected, and a step amplitude of each stage can be freely set. Switches on different stages are independent from each other, or disposed on at least one insulator (PCB board).

In another embodiment, the first parallel resistor, the first serial switch, and the first parallel switch are disposed on the insulator, and the first serial resistor and the second serial resistor are disposed on the substrate. The principle is the same as the first embodiment, and will not be described hereinafter.

Figure 25:
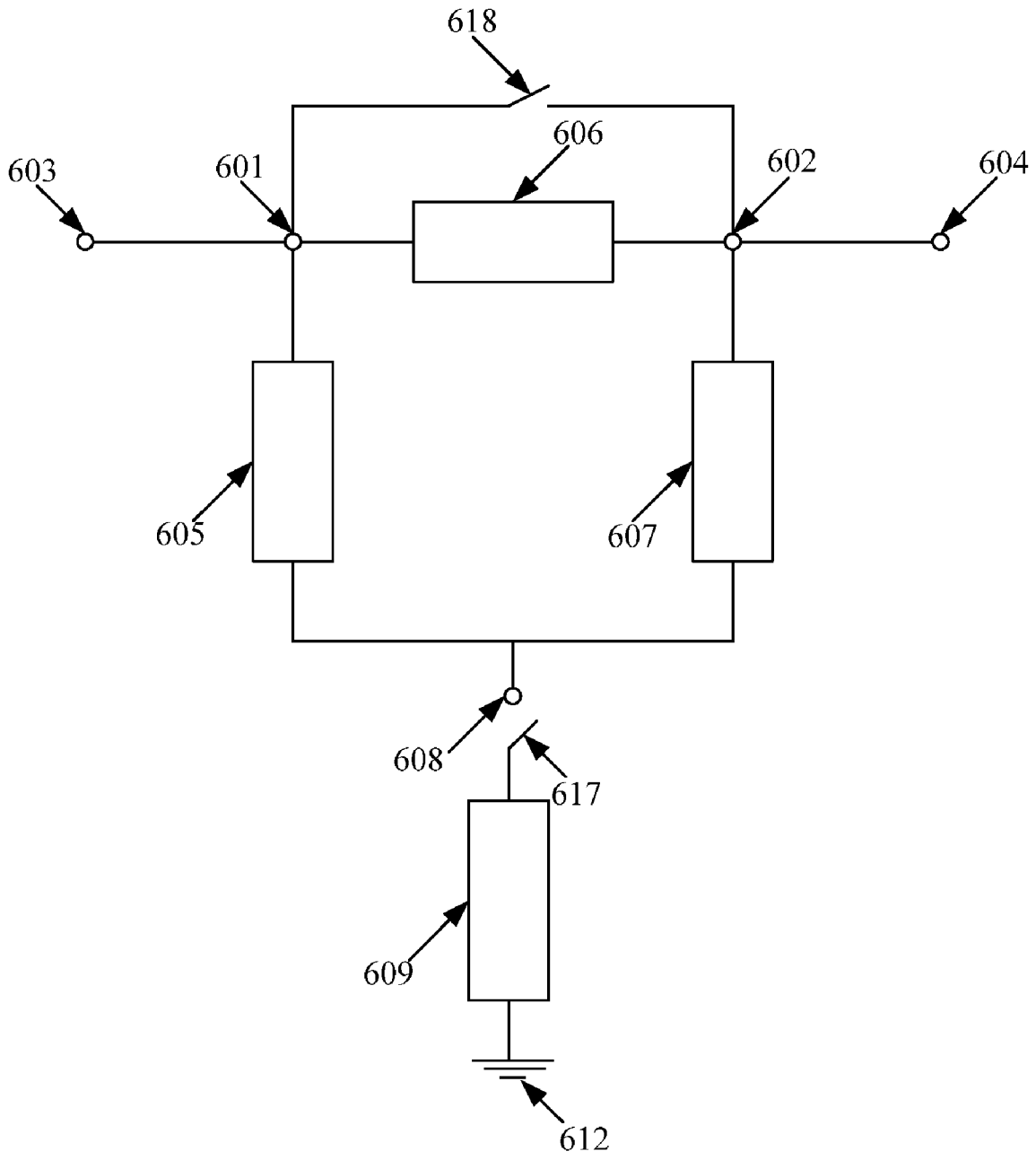
FIG. 25 is a schematic diagram of a variable attenuator of a sixth embodiment of the invention.

As shown in FIG. 25, a bridge-type attenuator circuit is shown. A parallel switch 618 is parallel connected between both terminals 601 and 602 of a serial resistor 609. A bridge-arm resistor 605 is connected to a terminal 601 of the serial resistor 609. Another bridge-arm resistor 607 is connected to a terminal 602 of the serial resistor 609. The other end of each of the bridge-arm resistors 605 and 607 is connected to a connecting point. The connecting point is connected to a closed contact 608 on one end of a serial switch 617, and the other end of the serial switch 617 is connected to a parallel resistor 609. The other end of the parallel resistor 609 is connected to a common grounded end 612. In another embodiment, the serial switch 617 is disposed between the parallel resistor 609 and the common grounded end 612.

Figure 26:
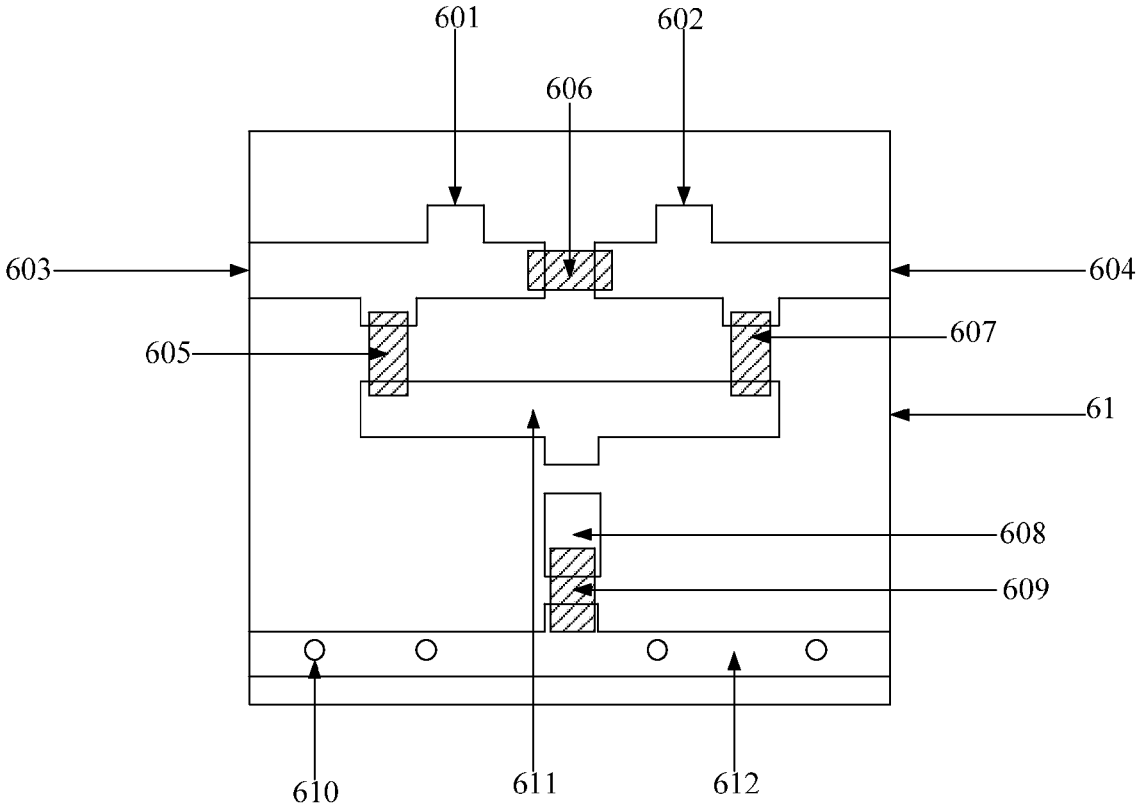
FIG. 26 is a schematic view of a surface layer of a substrate of a variable attenuator of a sixth embodiment of the invention.

As shown in FIG. 26, the substrate 61 is a double-layered PCB board. In other embodiments, the substrate 61 may be made of other materials such as ceramics and so on. A signal input end 603, a signal output end 604, a serial resistor 606, a pair of resistors 605 and 607 each having a resistance of 50 ohm, and a parallel resistor 609 are disposed on a surface of the PCB board. Both terminals 601 and 602 of the serial resistor 606 are connected to the signal input end 603 and the signal output end 604 via signal microstrip lines. One end of the resistor 605 is connected to the signal input end 603, the other end thereof is connected to a terminal 611. One end of the resistor 607 is connected to the signal output end 604, and the other end thereof is connected to the terminal 611. A terminal 608 of the parallel resistor 609 is serially connected to a switch and then to the terminal 611. The other end of the parallel resistor 609 is connected to a common grounded end 612. In another embodiment, the switch is connected to the other end of the parallel resistor 609, namely between the parallel resistor 609 and the common grounded end 612. In a further embodiment, a pair of switches are connected to the resistors 605 and 607 whereby replacing the switch serially connected to the parallel resistor 609, and another switch is parallel connected between both ends of the serial resistor 606. The common grounded end 612 is connected to a metal plate on the bottom layer of the substrate via a grounded through hole 610. It should be noted that all the resistors can be disposed on the bottom layer of the substrate, or parts of the resistors are disposed on the bottom layer and the rest of the resistors are disposed on a surface layer of the insulator.

Figure 27:
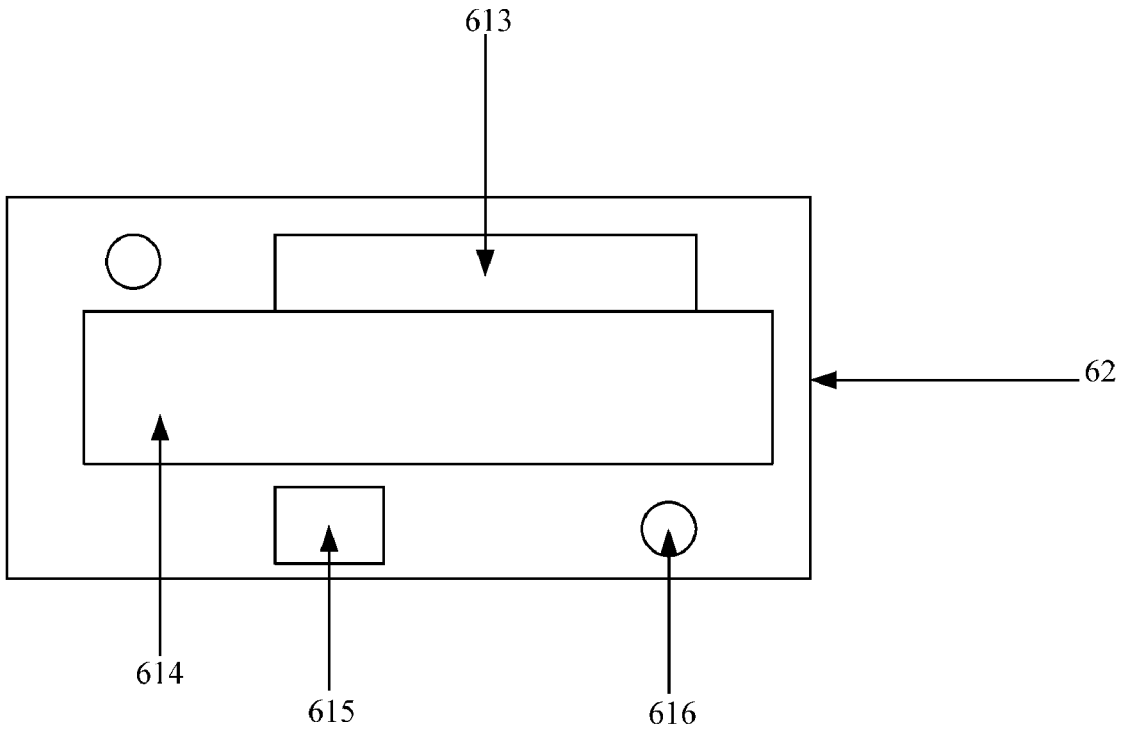
FIG. 27 is a schematic view of a switch of a variable attenuator of a sixth embodiment of the invention.

As shown in FIG. 27, parallel switches and serial switches of the variable attenuator are toggle switches implemented via conductive sheets, so as to save cost and to make it possible for the serial resistors and the parallel resistors to be smoothly connected to the main signal circuit as the parallel switches and the serial switches are switched. A width of the conductive sheet is the same as a bandwidth whereby obtaining an optimum attenuation. In another embodiment, the switch may be a rotary switch implemented by a conductive sheet. The conductive sheets are made of conductive materials such as conductors, and disposed on the same insulator 62 so that the parallel switches and the serial switches operate simultaneously. In another embodiment, the parallel switches and the serial switches are disposed on different insulators. The insulator 62 is a PCB board. The conductive sheet 613 operates as a parallel switch of the serial resistor 606, a width of each of the conductive 613 is the same as that of a signal microstrip line, and the conductive sheet 613 should be long enough to shorten the terminals 601 and 602. The conductive sheet 615 operates as a serial switch of the parallel resistor 609. A side of the PCB board on which the conductive sheet is disposed on is contacted with the surface layer of the substrate 61. The PCB board is contacted with the serial resistor 606 and the resistor having a resistance of 50 ohm whereby preventing the conductive sheet from moving. A slot 614 and a transition hole 616 are disposed on the PCB board.

Figure 28:
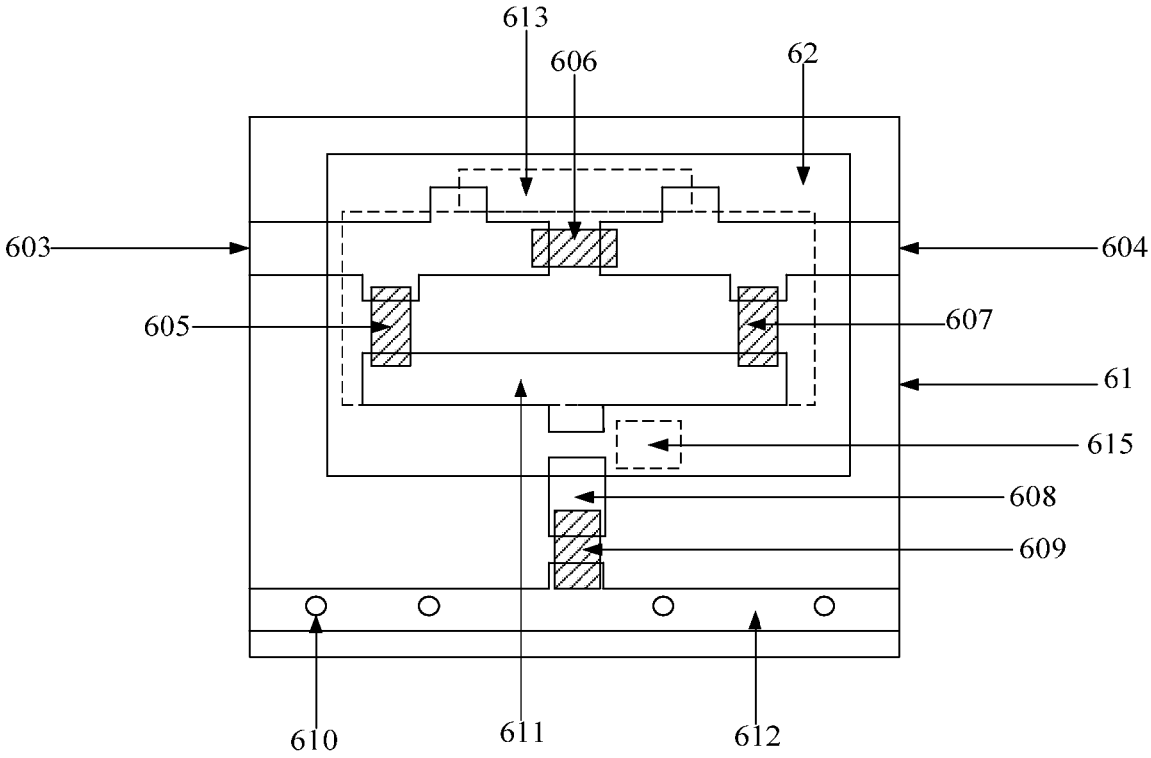
FIG. 28 illustrates a combination of the switch in FIG. 27 with a substrate.

As shown in FIG. 28, a part indicated by a dashed line illustrates a PCB board 62 in FIG. 27 (rotating by 180 degrees) on the substrate 61. The serial resistor 606 is shortened by the conductive sheet 613, the parallel resistor 609 is not connected to the main signal circuit, namely signal is directly transmitted from the signal input end to the signal output end. At this time, attenuation of the variable attenuator is 0 dB. As the PCB board 62 is moved to the left so that the conductive sheet 613 detaches from the terminal 602 of the serial resistor 606 and at the same time the conductive sheet 615 is connected to the terminal 611 of the parallel resistor 609.

Thus a typical bridge-type attenuator circuit with designed attenuation is formed. If resistance of the serial resistor 606 is 21 ohm, and that of the parallel resistor 609 is 121 ohm, a variable attenuator having attenuation changing from 0 dB to 3 dB is formed, and the variation process is reversible.

A multi-stage variable attenuator can be obtained if multiple above-mentioned attenuator circuits are serially connected, and a step amplitude of each stage can be freely set. Switches on different stages are independent from each other, and all the switches can be disposed on at least one insulator (PCB board).

It should be noted that as a multi-stage attenuator can be formed by attenuator circuits of the same type, or by different types of attenuator circuits, for example, π-type attenuator circuits and T-type attenuator circuits serially connected to each other, T-type attenuator circuits and π-type attenuator circuits serially connected to each other, and so on.

In this embodiment, the serial switches, the parallel resistors and the parallel switches are disposed on the insulator, and the serial resistors are disposed on the substrate. The principle is the same as the first embodiment, and will not be described hereinafter.

Figure 29:
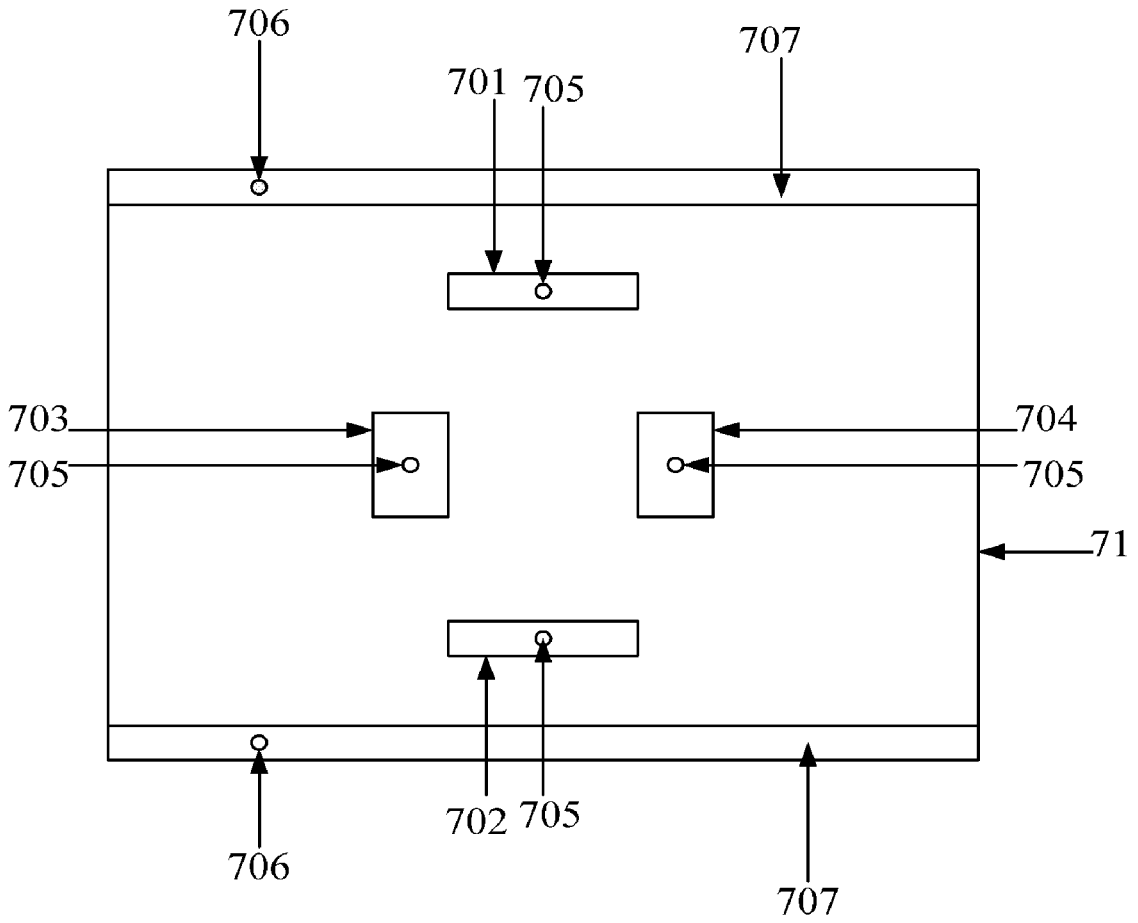
FIG. 29 is a schematic view of a surface layer of a substrate of a variable attenuator of a seventh embodiment of the invention.

As shown in FIG. 29, a substrate 71 is a double-layered RF ceramic substrate. In other embodiments, other number of layers can also be used, and the substrate 71 can be a PCB board and so on. Four terminals 701, 702, 703 and 704 are disposed on a surface layer of the substrate 71, and connected to corresponding terminals on a bottom layer thereof via a signal through hole 705, respectively. A common grounded end 707 is disposed on the surface layer thereof, and connected to a grounded end on the bottom layer thereof via a grounded through hole 706.

Figure 30:
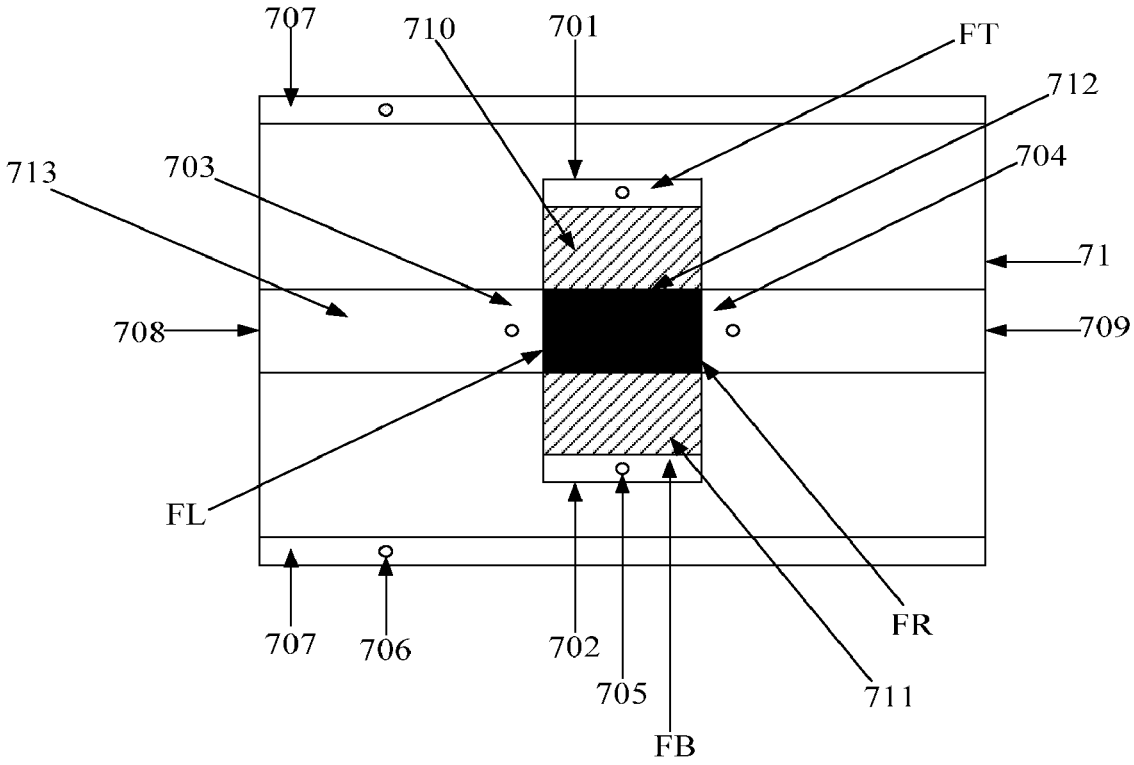
FIG. 30 is a schematic view of a bottom layer of a substrate of a variable attenuator of a seventh embodiment of the invention.

As shown in FIG. 30, a signal input end 708, a signal output end 709, a first serial resistor 712, a first parallel resistor 710, a second parallel resistor 711, and a common grounded end 707 are disposed on a substrate 71. The first serial resistor 712, the first parallel resistor 710, and the second parallel resistor 711 are film resistors.

Film resistors refer to resistors that are made by a thick film process or a thin film process. In principle, before protecting layer is coated, four sides of the film resistor can be electrically connected to each other.

The signal input end 708 is connected to a terminal 703 via a signal microstrip line 713, the terminal 703 is connected to one side (left side) FL of the first serial resistor 712, the other side (right side) FR of the first serial resistor 712 is connected to a terminal 704, the terminal 704 is connected to the signal output end 709 via the signal microstrip line 713. An upper side of the first serial resistor 712 is connected to one end of the first parallel resistor 710, and the other end FT (upper end) of the first parallel resistor 710 is connected to a terminal 701. A bottom side of the first serial resistor 712 is connected to one end of the second parallel resistor 711, and the other end FB (lower end) of the second parallel resistor 711 is connected to a terminal 702. Both ends of the first serial resistor 712 are respectively connected to the signal input end 708 and the signal output end 709. The first serial resistor 712, the first parallel resistor 710, and the second parallel resistor 711 can be integrally formed.

Figure 31:
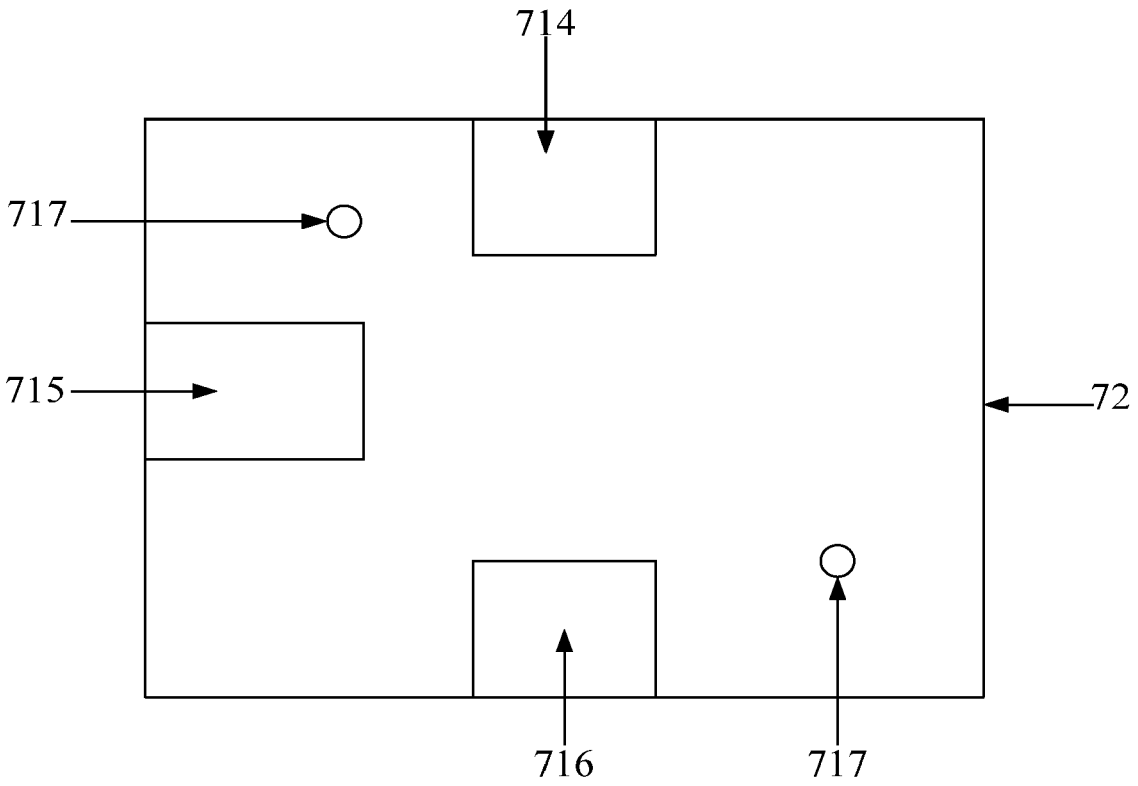
FIG. 31 is a schematic view of a switch of a variable attenuator of a seventh embodiment of the invention.

As shown in FIG. 31, switches of the variable attenuator are toggle switches implemented via conductive sheets, so as to save cost and to make it possible for the first serial resistor, the first parallel switch and the second parallel resistor to be smoothly connected to the main signal circuit as the first parallel switch, the first serial switch and the second serial switch are switched. A width of the conductive sheet is the same as a bandwidth whereby obtaining an optimum attenuation. In another embodiment, the switch may be a rotary switch implemented by a conductive sheet. The conductive sheets are made of conductive materials such as conductors, and disposed on the same insulator 72 so that a switch of the first serial resistor and switches of the first parallel resistor and the second parallel resistor operate simultaneously. In another embodiment, all the switches are disposed on different insulators. The insulator 72 is a PCB board. The conductive sheet 715 is connected to terminals 703 and 704, and operates as a parallel switch of the first serial resistor 712. The conductive sheet 714 is connected to a terminal 701 and a common grounded end 707, and operates as a switch to serially connect the first parallel resistor 701 to the common grounded end 707. The conductive sheet 716 is connected to a terminal 702 and the common grounded end 707, and operates as a switch to serially connect the second parallel resistor 702 to the common grounded end 707. A transition hole 717 operates to move the PCB board.

Figure 32:
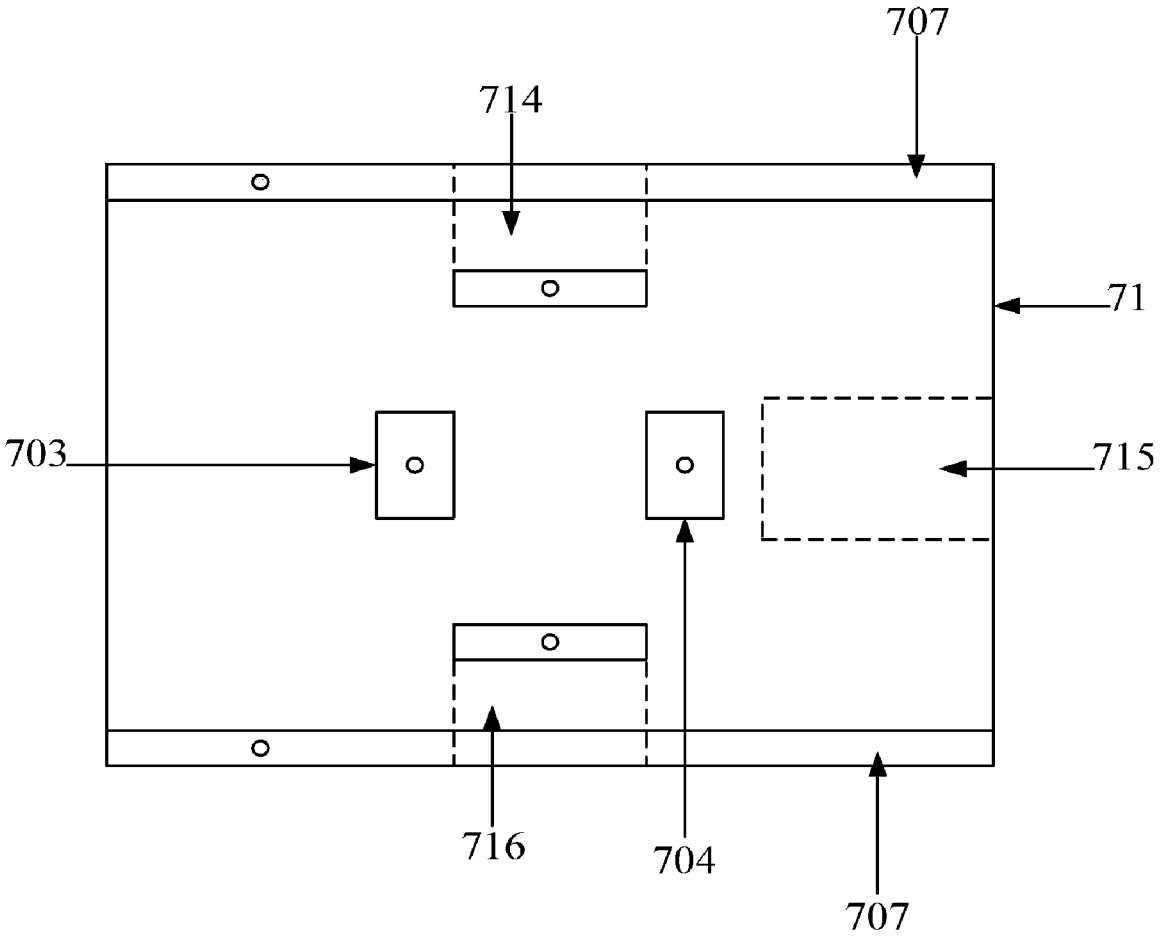
FIG. 32 illustrates a combination of the switch in FIG. 31 with a substrate.

As shown in FIG. 32, a part indicated by a dashed line illustrates a PCB board in FIG. 31 (rotating by 180 degrees) on the substrate 71. A side of the PCB board on which a conductive sheet is disposed on is contacted with the surface layer of the substrate 71. The conductive sheet 714 connects the terminal 701 of the first parallel resistor 710 to the common grounded end 707, namely the serial switch connected to the first parallel resistor 710 is switched on. The conductive sheet 716 connects the terminal 702 of the second parallel resistor 711 to the common grounded end 709, namely the serial switch connected to the second parallel resistor 711 is switched on.

The PCB board is contacted with the serial resistor 606 and the resistor having a resistance of 50 ohm. A slot 614 and a transition hole 616 are disposed on the PCB board. The serial resistor 606 is shortened by the conductive sheet 613, the parallel resistor 609 is not connected to the main signal circuit, namely signal is directly transmitted from the signal input end to the signal output end. At this time, attenuation of the variable attenuator is 0 dB. As the PCB board 62 is moved to the left so that the conductive sheet 613 detaches from the terminal 602 of the serial resistor 606 and at the same time the conductive sheet 615 is connected to the terminal 611 of the parallel resistor 609. A side of the PCB board on which the conductive sheet is disposed on is contacted with the surface layer of the substrate 61. The PCB board is contacted with the serial resistor 606 and the resistor having a resistance of 50 ohm. A slot 614 and a transition hole 616 are disposed on the PCB board. At this time, the parallel switch connected to the first serial resistor 712 is switched off, and the variable attenuator is a typical film attenuator, and attenuation thereof can be determined according to design requirement. As the PCB board is moved from right to left, both ends 703 and 704 (FL and FR) of the first serial resistor 712 are shortened by the conductive sheet 715, namely the parallel switch connected to the first serial resistor 712 is switched on. At this time, the conductive sheet 714 detaches from the terminal 701, namely the serial switch connected to the first parallel resistor 710 is switched off, the conductive sheet 716 detaches from the terminal 702, namely the serial switch connected to the second parallel resistor 711 is switched off, and attenuation of the variable attenuator is 0 dB. Thus variation of attenuation of the variable attenuator (from a step amplitude to 0 dB) is facilitated.

A multi-stage variable attenuator can be obtained if multiple above-mentioned attenuator circuits are serially connected, and a step amplitude of each stage can be freely set. Switches on different stages are independent from each other, and all the switches can be disposed on at least one insulator (PCB board). The first serial resistor 712, the first parallel resistor 710, and the second parallel resistor 711 are integrally formed into a film resistor. The variable attenuator is equivalent to several π-type attenuators that are serially connected, and finally to a π-type attenuator circuit.

In this embodiment, the first parallel resistor 710, the second parallel resistor 711, the first serial switch, the second serial switch, and the first parallel switch are disposed on the same insulator, and the first serial resistor 712 is disposed on the substrate. The principle is the same as the first embodiment, and will not be described hereinafter.

Figure 33:
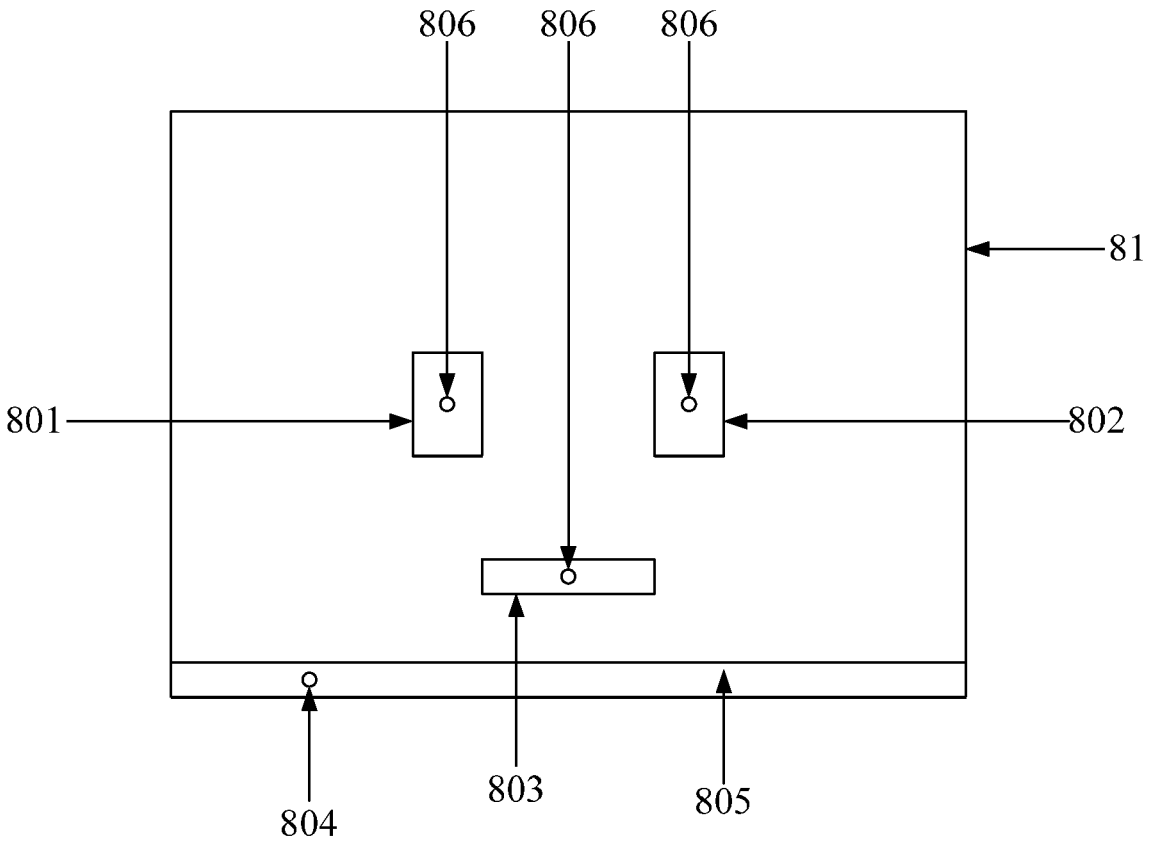
FIG. 33 is a schematic view of a surface layer of a substrate of a variable attenuator of an eighth embodiment of the invention.

As shown in FIG. 33, a substrate 81 is a double-layered RF ceramic substrate. In other embodiments, the substrate 81 can be a PCB board and so on. Three terminals 801, 802, and 803 are disposed on a surface layer of the substrate 81, and connected to corresponding terminals on a bottom layer thereof via a signal through hole 806, respectively. A common grounded end 805 is disposed on the surface layer thereof, and connected to a grounded end on the bottom layer thereof via a grounded through hole 804.

Figure 34:
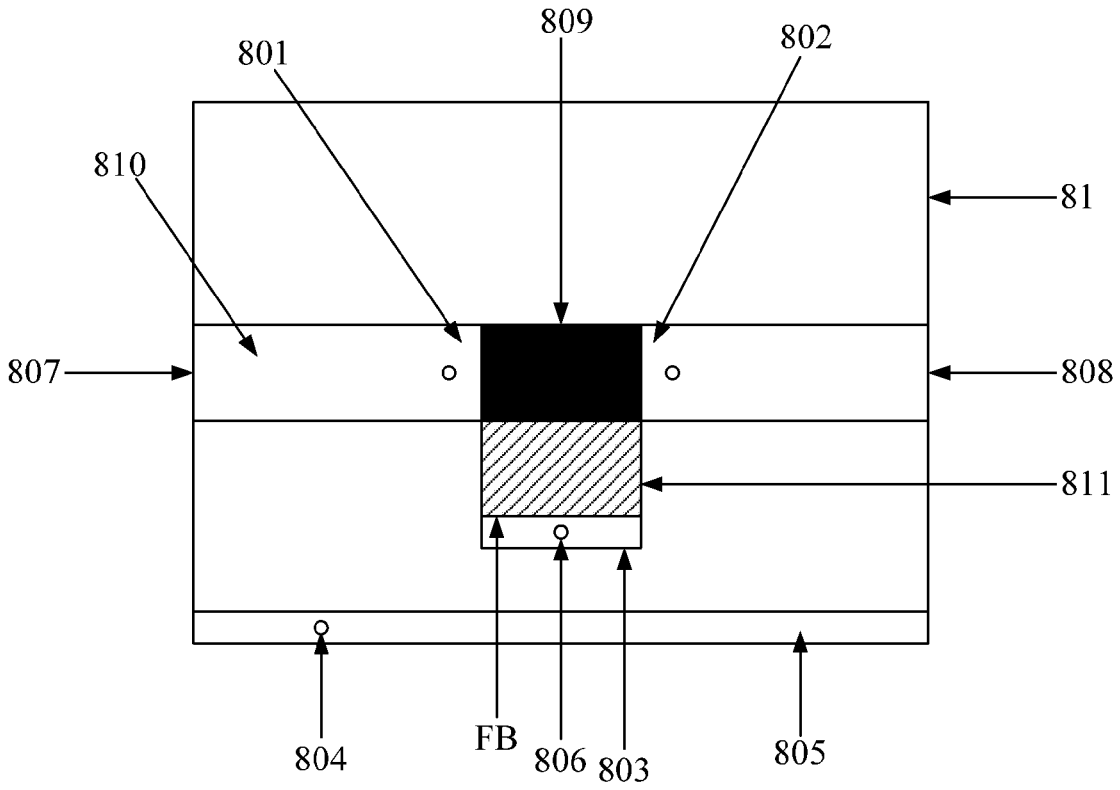
FIG. 34 is a schematic view of a bottom layer of a substrate of a variable attenuator of an eighth embodiment of the invention.

As shown in FIG. 34, a signal input end 807, a signal output end 808, a first serial resistor 809, a first parallel resistor 811, and a common grounded end 805 are disposed on the substrate 81. The first serial resistor 809 and the first parallel resistor 811 are film resistors.

Film resistors refer to resistors that are made by a thick film process or a thin film process. In principle, before protecting layer is coated, four sides of the film resistor can be electrically connected to each other.

The signal input end 807 is connected to a terminal 801 via a signal microstrip line 810, the terminal 801 is connected to one side (left side) of the first serial resistor 809, the other side (right side) of the first serial resistor 809 is connected to a terminal 802, the terminal 802 is connected to the signal output end 808 via the signal microstrip line 810. A lower side of the first serial resistor 809 is connected to one end of the first parallel resistor 811, and the other end (lower end) of the first parallel resistor 811 is connected to a terminal 803. Both ends of the first serial resistor 809 are respectively connected to the signal input end 807 and the signal output end 808. The first serial resistor 809 and the first parallel resistor 811 can be integrally formed.

Figure 35:
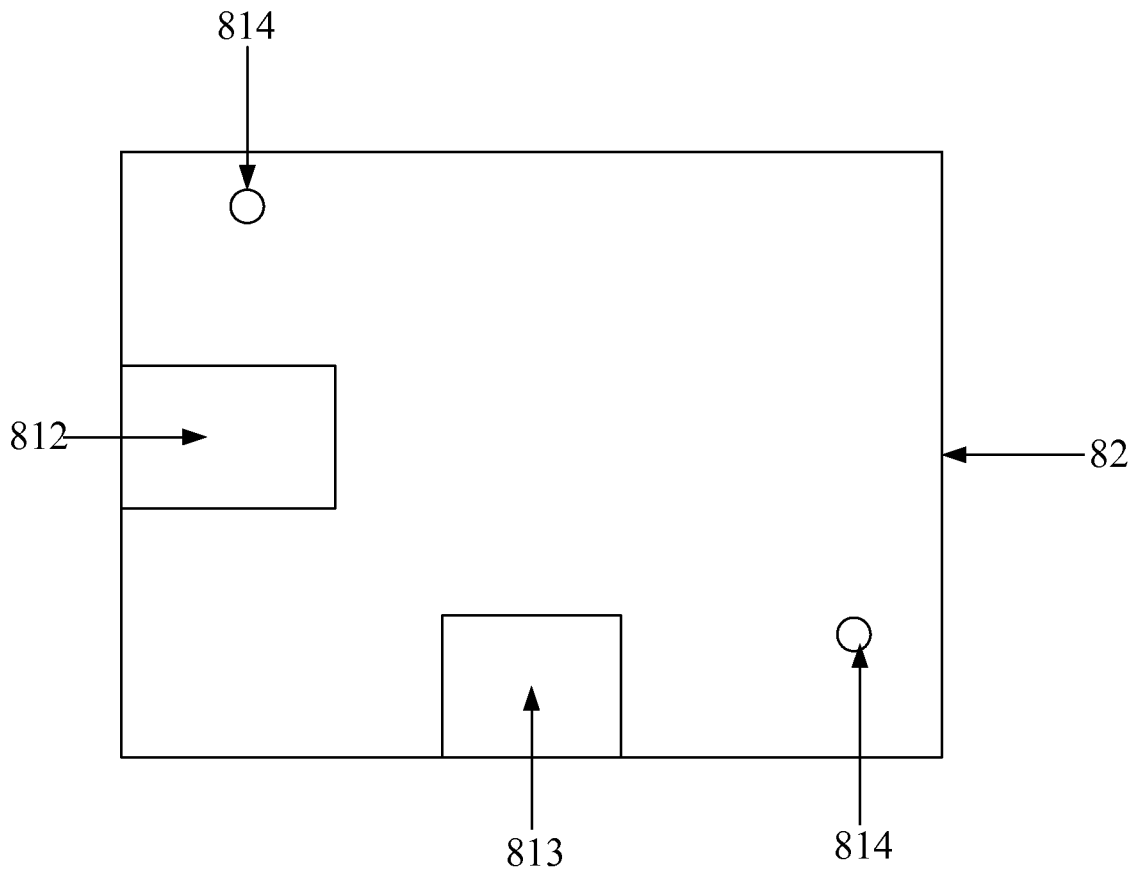
FIG. 35 is a schematic view of a switch of a variable attenuator of an eighth embodiment of the invention.

As shown in FIG. 35, switches of the variable attenuator are toggle switches implemented via conductive sheets, so as to save cost and to make it possible for the first serial resistor 809 and the first parallel resistor 811 to be smoothly connected to the main signal circuit as the first parallel switch and the first serial switch are switched. A width of the conductive sheet is the same as a bandwidth whereby obtaining an optimum attenuation. In another embodiment, the switch may be a rotary switch implemented by a conductive sheet. The conductive sheets are made of conductive materials such as conductors, and disposed on the same insulator 82 so that a switch of the first serial resistor 809 and a switch of the first parallel resistor 811 operate simultaneously. In another embodiment, all the switches are disposed on different insulators. The insulator 82 is a PCB board. All conductive sheets can be disposed on the same PCB board. The conductive sheet 812 is connected to terminals 801 and 802, and operates as a parallel switch of the first serial resistor 809. The conductive sheet 813 is connected to a terminal 803 and a common grounded end 805, and operates as a switch to serially connect the first parallel resistor 811 to the common grounded end 805. A transition hole 814 operates to move the PCB board.

Figure 36:
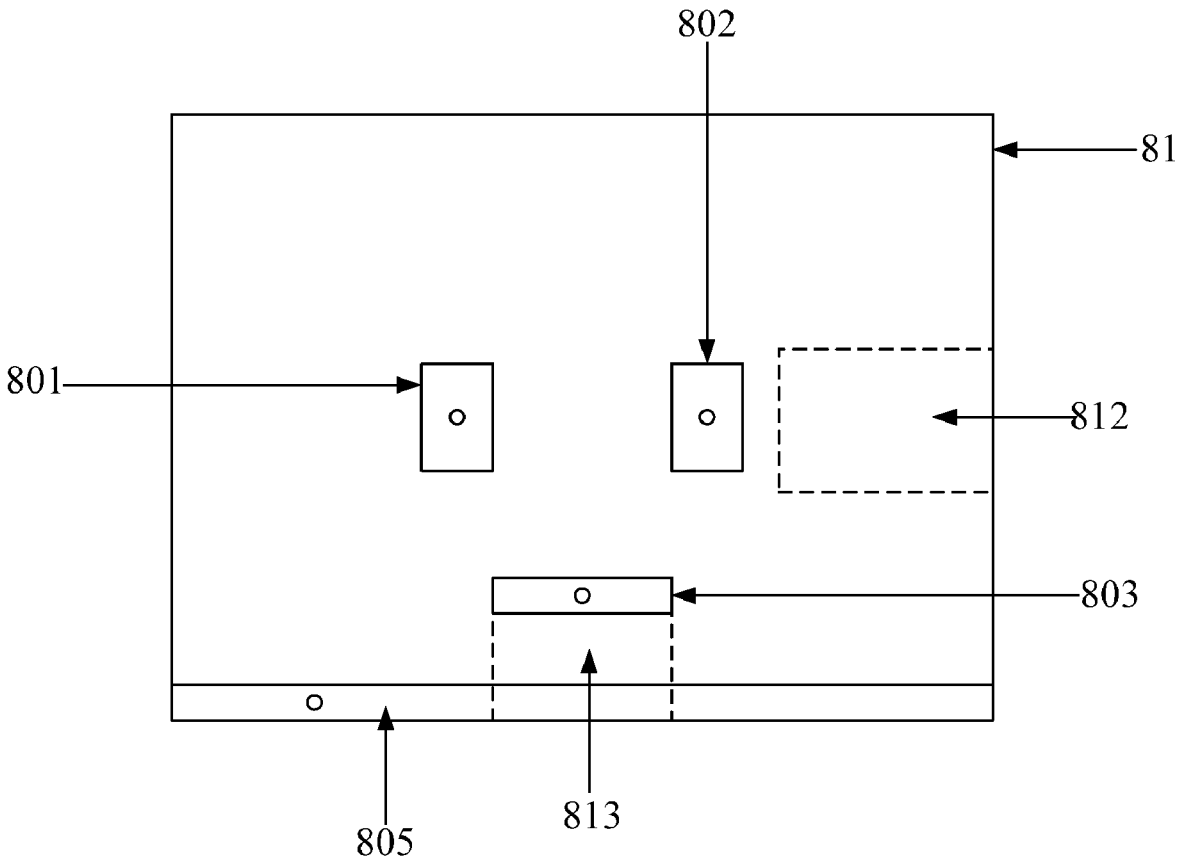
FIG. 36 illustrates a combination of the switch in FIG. 35 with a substrate.

As shown in FIG. 36, a part indicated by a dashed line illustrates a PCB board in FIG. 35 (rotating by 180 degrees) on the substrate 81. A side of the PCB board on which a conductive sheet is disposed on is contacted with the surface layer of the substrate 81. The conductive sheet 813 connects the terminal 803 of the first parallel resistor 811 to the common grounded end 805, namely the serial switch connected to the first parallel resistor 811 is switched on, and the parallel switch connected to the first serial resistor 809 is switched off. At this time, the variable attenuator is a typical film attenuator, and attenuation thereof can be determined according to design requirement. As the PCB board is moved from right to left, both ends 801 and 802 of the first serial resistor 809 are shortened by the conductive sheet 812, namely the parallel switch connected to the first serial resistor 809 is switched on. At this time, the conductive sheet 813 detaches from the terminal 803, namely the serial switch connected to the first parallel resistor 811 is switched off, and attenuation of the variable attenuator is 0 dB. Thus variation of attenuation of the variable attenuator is facilitated, and the process is reversible.

A multi-stage variable attenuator can be obtained if multiple above-mentioned attenuator circuits are serially connected, and a step amplitude of each stage can be freely set. Switches on different stages are independent from each other, and all the switches can be disposed on at least one insulator (PCB board). The first serial resistor 809 and the first parallel resistor 811 are integrally formed into a film resistor. The variable attenuator is equivalent to several T-type attenuators that are serially connected, and finally to a T-type attenuator circuit.

In this embodiment, the first parallel resistor, the second serial switch and the first parallel switch are disposed on the same insulator, and the first serial resistor is disposed on the substrate. The principle is the same as the first embodiment, and will not be described hereinafter.

The variable attenuator can be encapsulated via a metal housing connected to a coaxial connector, a coaxial connector, or a plastic sauter mean diameter (SMD). The coaxial connector can be a SMA-type or a N-type coaxial connector. The switch may be a toggle switch or a rotary switch.

Figure 37:
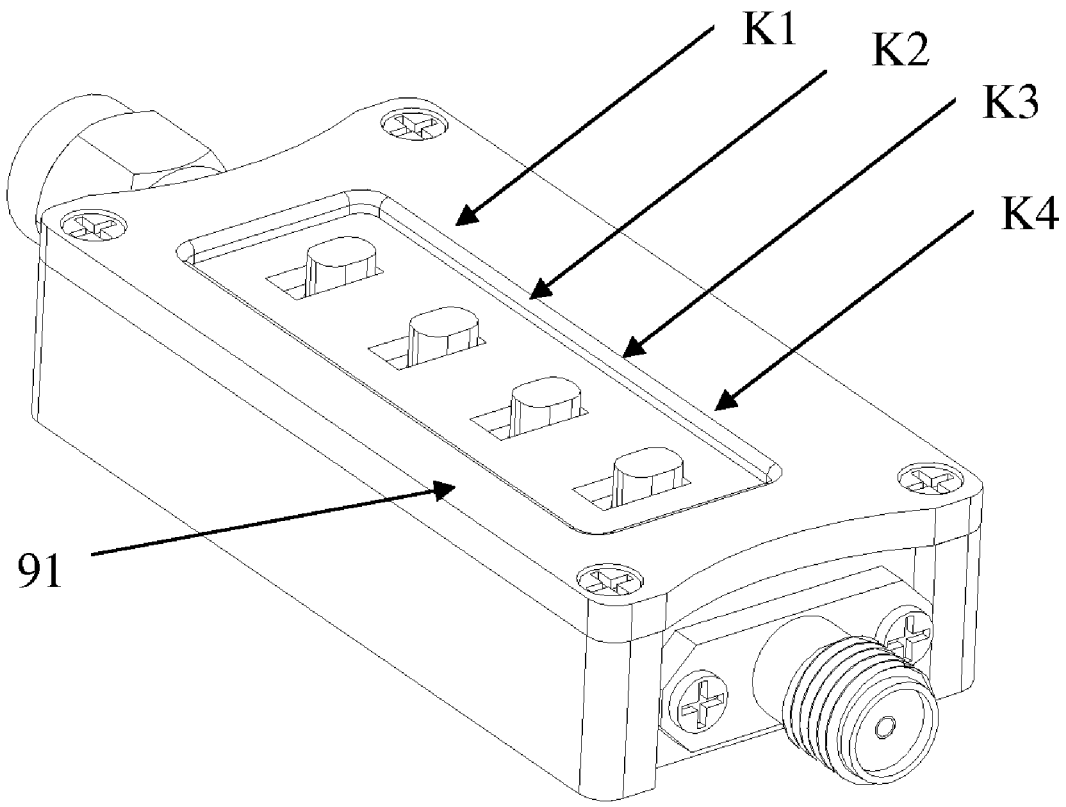
FIG. 37 is a schematic view of a coaxial connector with a metal housing.

As shown in FIG. 37, a housing of the variable attenuator is a metal housing 91, a pair of SMA coaxial fitting is disposed on both sides thereof, and four toggle switches K1, K2, K3 and K4 are disposed on the surface thereof and operate to adjust attenuation.

Figure 38:
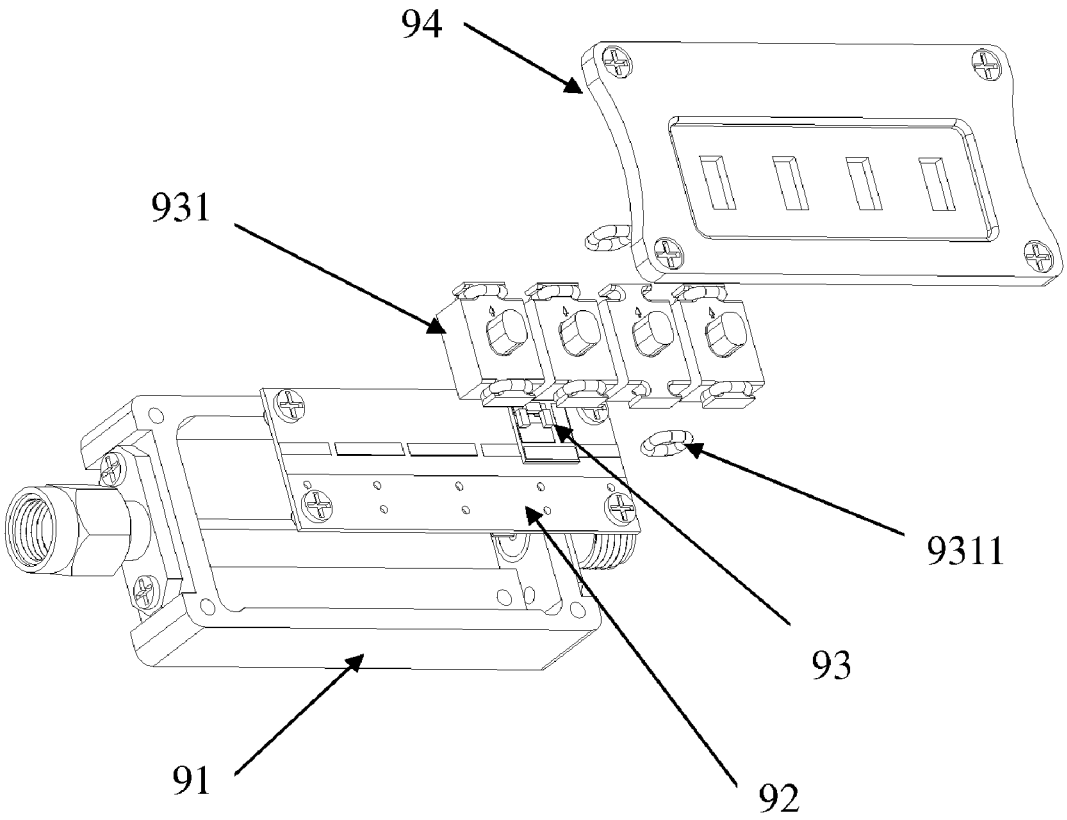
FIG. 38 is an exploded view of a coaxial connector in FIG. 37.

As shown in FIG. 38, a substrate 92 is disposed in the metal housing 91, an insulator 93 is disposed above the substrate 92, a post 931 is disposed on the insulator 93, a pair of silicon rubber rings 9311 are disposed on both ends of the 931, and operate to tightly fix the insulator 93 to the surface layer of the substrate 92, a metal cover 94 is disposed at the top of the substrate 92 and fixes the silicon rubber rings 9311 via screws.

Figure 39:
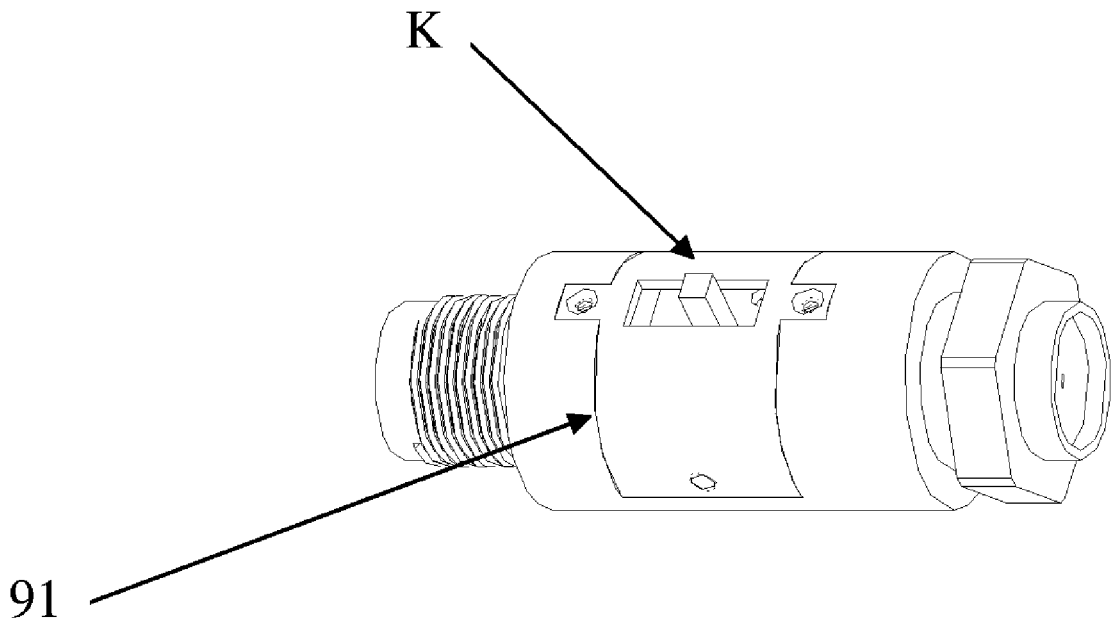
FIG. 39 is a schematic view of an integral coaxial connector.

As shown in FIG. 39, a coaxial connector having same structure as that in FIG. 38 can be used to replace the metal housing. In this embodiment, the coaxial connector can be a SMA-type or a N-type coaxial connector, and features convenient use, compact structure, and low cost for mass production.

The invention employs the parallel switch parallel connected to the serial resistor, and the serial switch serially connected to the parallel resistor, as the parallel switch is switched on to eliminate attenuation on a certain stage, the serial switch is switched off, whereby preventing the parallel resistor from affecting the main signal circuit and ensuring stable attenuation with higher precision and a wider frequency range; moreover, switching of the main signal circuit is not required, which ensures that a signal is always transmitted on the main signal circuit and no reflection signal (burst pulse) is generated on the main signal circuit, and thus a circuit on a previous stage will not be damaged.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A variable attenuator, comprising:

at least one-stage attenuator circuit, comprising a signal input end, a signal output end, a common grounded end;

a first serial resistor;

a first parallel resistor;

a first parallel switch; and a first serial switch;

wherein:

said first serial resistor is disposed between said signal input and said signal output end;

said signal input, said signal output end, and said first serial resistor form a main signal circuit;

said first parallel resistor is connected between said main signal circuit and said common grounded end;

said first parallel switch or said first serial switch is a conductive sheet or a signal microstrip line disposed on a substrate;

said first parallel switch is parallel connected to said first serial resistor; and said first serial switch is serially connected to said first parallel resistor.

2. The variable attenuator of claim 1, wherein said first serial resistor, said first parallel resistor, said first serial switch, said first parallel switch, said signal input end, and said signal output end or said common grounded end are disposed on different substrates or insulators operating as switches.

3. A variable attenuator, comprising at least one-stage π-type attenuator circuit, said one-stage π-type attenuator circuit comprising:

a signal input end;

a signal output end;

a common grounded end;

a first serial resistor;

a first parallel resistor;

a second parallel resistor;

a first parallel switch;

a first serial switch; and a second serial switch;

wherein:

said first serial resistor is disposed between said signal input end and said signal output end;

said signal input end, said signal output end, and said first serial resistor form a main signal circuit;

said first parallel switch is parallel connected to said first serial resistor;

said first serial switch is serially connected to said first parallel resistor;

said second parallel resistor and said second serial switch are serially connected to each other;

said first parallel resistor is connected between said signal input end and said common grounded end; and said second parallel resistor is connected between said signal output end and said common grounded end.

4. The variable attenuator of claim 3, wherein:

said at least one-stage attenuator circuit is an multi-stage π-type attenuator circuit;

a signal output end of a previous stage of said multi-stage π-type attenuator circuit operates as a signal input end of a next stage of said multi-stage π-type attenuator circuit; and a second parallel resistor connected between said signal output end and said common grounded end of said previous stage of said multi-stage π-type attenuator circuit operates as a first parallel resistor between a signal input end and a common grounded end of said next stage of said multi-stage cascaded π-type attenuator circuit.

5. The variable attenuator of claim 4, wherein said first serial resistor, said first parallel resistor, said second parallel resistor, said first serial switch, said second serial switch, said first parallel switch, said signal input end, and said signal output end or said common grounded end are disposed on different substrates or insulators operating as switches.

6. The variable attenuator of claim 5, wherein said first parallel switch, said first serial switch, or said second serial switch is a conductive sheet, or a signal microstrip line disposed on a substrate.

7. A variable attenuator, comprising at least one-stage T-type attenuator circuit, comprising:

a signal input end;

a signal output end;

a common grounded end;

a first serial resistor;

a second serial resistor;

a first parallel resistor;

a first parallel switch;

a second parallel switch; and a first serial switch;

wherein:

said first serial resistor and said second serial resistor are serially connected;

one end of said first serial resistor is connected to said signal input end;

one end of said second serial resistor is connected to said signal output end;

said signal input end, said signal output end, said first serial resistor, and said second serial resistor form a main signal circuit;

said first parallel switch is parallel connected to said first serial resistor;

said second parallel switch is parallel connected to said second serial resistor;

said first parallel resistor is connected to said common grounded end;

a connecting point between one end of said-first parallel resistor and said main signal circuit is disposed between said first serial resistor and said second serial resistor; and said first parallel switch and said second parallel switch are serially connected at said connecting point.

8. The variable attenuator of claim 7, wherein said first serial resistor, said first parallel resistor, said second serial resistor, said first serial switch, said first parallel switch, said second parallel switch, said signal input end, and said signal output end or said common grounded end are disposed on different substrates or insulators operating as switches.

9. The variable attenuator of claim 7, wherein said first parallel switch, said second parallel switch, or said first serial switch is implemented by a conductive sheet, or a signal microstrip line disposed on a substrate.

10. A variable attenuator, comprising at least one-stage T-type attenuator circuit, said one-stage T-type attenuator circuit comprising:

a signal input end;

a signal output end;
a common grounded end;
a first serial resistor;
a second serial resistor;
a first parallel resistor;
a first parallel switch; and
a first serial switch;
wherein:
said first serial resistor and said second serial resistor are serially connected;
one end of said first serial resistor is connected to said signal input end;
one end of said second serial resistor is connected to said signal output end;
said signal input end, said signal output end, said first serial resistor, and said second serial resistor form a main signal circuit;
said first parallel switch is parallel connected between-the end of said first serial resistor and that of said second serial resistor;
said first serial switch is serially connected to said first parallel resistor;
said first parallel resistor is connected to said common grounded end; and
a connecting point between one end of said first parallel resistor and said main signal circuit is disposed between said first serial resistor and said second serial resistor.

11. The variable attenuator of claim 10, wherein said first serial resistor, said first parallel resistor, said second serial resistor, said first serial switch, said first parallel switch, said second parallel switch, said signal input end, and said signal output end or said common grounded end are disposed on different substrates or insulators operating as switches.

12. The variable attenuator of claim 10, wherein said first parallel switch, said second parallel switch, or said first serial switch is implemented by a conductive sheet, or a signal microstrip line disposed on a substrate.

13. The variable attenuator of claim 7, wherein said first serial switch is disposed between said first parallel resistor and said common grounded end, or between said-first parallel resistor and said main signal circuit.

14. The variable attenuator of claim 3, further comprising at least one correcting circuit comprising a third parallel resistor and a circuit-switch, wherein:
one end of said circuit switch is connected to said signal input end, said signal output end, or a cascade on said main signal circuit;
the other end of said circuit switch is connected to one end of said third parallel resistor; and
the other end of said third parallel resistor is disposed on a microstrip terminal, or connected to said common grounded end directly or via a capacitor or an inductor.

15. The variable attenuator of claim 3, wherein:
said at least one-stage π-type attenuator circuit is disposed on a substrate, or an insulator operating as a switch; and
said first serial resistor, said first parallel resistor, said first serial switch, said second parallel resistor, said second serial switch, and said first parallel switch are disposed on the same layer or different layers of said substrate.

16. The variable attenuator of claim 3, wherein said variable attenuator is disposed in a coaxial connector.

17. The variable attenuator of claim 3, wherein said first serial resistor, said second serial resistor, and said first parallel resistor are chip resistors, thick film resistors, thin film resistors, embedded resistors, printed resistors, or a combination thereof.

18. The variable attenuator of claim 10, further comprising a fourth resistor, wherein:
said first serial resistor and said second serial resistor are bridge-arm resistors;
said fourth resistor is disposed between said signal input and said signal output end;
said signal input, said signal output end, and said fourth resistor form a main signal circuit;
one end of each of said bridge-arm resistors is connected to said fourth resistor;
the other end of each of said bridge-arm resistors is connected to said connecting point;
said first parallel resistor is disposed between said connecting point and said common grounded end;
said first parallel switch is parallel connected to said fourth resistor; and
said first serial switch is serially connected to said first parallel resistor.

19. The variable attenuator of claim 18, wherein said first serial switch is disposed between said first parallel resistor and said common grounded end.

20. The variable attenuator of claim 18, wherein
said first serial switch is a conductive sheet or a signal microstrip line disposed on a substrate; and
said first parallel switch is a conductive sheet or a signal microstrip line disposed on a substrate.

21. The variable attenuator of claim 18, wherein:
said variable attenuator circuit is disposed on a substrate, or an insulator operating as a switch; and
said first serial resistor, said second serial resistor, said first parallel resistor, said fourth resistor, said first serial switch, and said first parallel switch are disposed on the same layer or different layers of said substrate.

22. The variable attenuator of claim 18, wherein said first serial resistor, said second serial resistor, said first parallel resistor, and said fourth resistor are chip resistors, thick film resistors, thin film resistors, embedded resistors, printed resistors, or a combination thereof.

23. The variable attenuator of claim 3, wherein:
said first serial switch is disposed between said first parallel resistor and said common grounded end, or between said first parallel resistor and said main signal circuit; and
said second serial switch is disposed between said second parallel resistor and said common grounded end, or between said second parallel resistor and said main signal circuit.

24. The variable attenuator of claim 7, further comprising at least one correcting circuit comprising a second parallel resistor and a circuit switch, wherein:
one end of said circuit switch is connected to said signal input end, said signal output end, or a cascade on said main signal circuit;
the other end of said circuit switch is connected to one end of said second parallel resistor; and
the other end of said second parallel resistor is disposed on a microstrip terminal, or connected to said common grounded end directly or via a capacitor or an inductor.

25. The variable attenuator of claim 18, further comprising at least one correcting circuit comprising a second parallel resistor and a circuit switch, wherein:
one end of said circuit switch is connected to said signal input end, said signal output end, or a cascade on said main signal circuit;
the other end of said circuit switch is connected to one end of said second parallel resistor; and the other end of said second parallel resistor is disposed on a microstrip terminal, or connected to said common grounded end directly or via a capacitor or an inductor.

26. The variable attenuator of claim 7, wherein:

said at least one-stage T-type attenuator circuit is disposed on a substrate, or an insulator operating as a switch; and said first serial resistor, said second serial resister, said first parallel resistor, said first serial switch, said second serial switch, and said first parallel switch are disposed on the same layer or different layers of said substrate.

27. The variable attenuator of claim 7, wherein said variable attenuator is disposed in a coaxial connector.

28. The variable attenuator of claim 18, wherein said variable attenuator is disposed in a coaxial connector.

29. The variable attenuator of claim 7, wherein said first serial resistor, said first parallel resistor, and said second parallel resistor are chip resistors, thick film resistors, thin film resistors, embedded resistors, printed resistors, or a combination thereof.

* * * * *